US009599380B2

(12) United States Patent
Yamashita

(10) Patent No.: US 9,599,380 B2
(45) Date of Patent: Mar. 21, 2017

(54) REFRIGERANT CHARGING METHOD FOR AIR-CONDITIONING APPARATUS AND AIR-CONDITIONING APPARATUS

(75) Inventor: Koji Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 262 days.

(21) Appl. No.: 14/345,666

(22) PCT Filed: Jan. 24, 2012

(86) PCT No.: PCT/JP2012/000419

§ 371 (c)(1),
(2), (4) Date: Mar. 19, 2014

(87) PCT Pub. No.: WO2013/111180

PCT Pub. Date: Aug. 1, 2013

(65) Prior Publication Data

US 2014/0216076 A1 Aug. 7, 2014

(51) Int. Cl.
*F25B 45/00* (2006.01)
*F25B 7/00* (2006.01)
(Continued)

(52) U.S. Cl.
CPC ..... *F25B 45/00* (2013.01); *F25B 9/006* (2013.01); *F25B 13/00* (2013.01);
(Continued)

(58) Field of Classification Search
CPC ..... F25B 45/00; F25B 13/00; F25B 9/006; F25B 2345/001; F25B 2345/003; F25B 2400/06; F25B 2313/0231
(Continued)

(56) References Cited

U.S. PATENT DOCUMENTS 5,651,263 A * 7/1997 Nonaka et al. ..... 62/205
5,711,158 A * 1/1998 Yoshida et al. ..... 62/77
(Continued)

FOREIGN PATENT DOCUMENTS

JP 62-77554 A 4/1987
JP H05-045868 B2 7/1993
(Continued)

OTHER PUBLICATIONS

Machine translations: JP 06221699 and JP 2011-094871.*
(Continued)

*Primary Examiner* — Ryan J Walters
*Assistant Examiner* — Joseph Trpisovsky
(74) *Attorney, Agent, or Firm* — Posz Law Group, PLC

(57) ABSTRACT

When a first temperature difference is the difference between a saturated gas temperature of a first refrigerant at an inlet side and a saturated liquid temperature of the first refrigerant at an outlet side in a heat exchanger for heating, and when a second temperature difference is the difference between a saturated gas temperature of a second refrigerant at an outlet side and a temperature of the second refrigerant at an inlet side in the heat exchanger for heating, the difference between the first temperature difference and the second temperature difference is held in a predetermined value or less by charging the second refrigerant to the second refrigeration cycle so that a plurality of single refrigerants forming the second refrigerant have a predetermined mixing ratio.

12 Claims, 11 Drawing Sheets

(51) Int. Cl.
*C09K 5/04* (2006.01)
*F25B 9/00* (2006.01)
*F25B 13/00* (2006.01)

(52) U.S. Cl.
CPC . *F25B 2313/0231* (2013.01); *F25B 2345/001* (2013.01); *F25B 2345/003* (2013.01); *F25B 2400/06* (2013.01)

(58) Field of Classification Search
USPC ..... 62/77, 292, 149, 175, 114, 335, 502
See application file for complete search history.

(56) References Cited

U.S. PATENT DOCUMENTS

| | | | | |
|---|---|---|---|---|
| 5,954,995 | A * | 9/1999 | Goble | 252/67 |
| 2005/0056031 | A1* | 3/2005 | Jeong | 62/126 |
| 2010/0282434 | A1* | 11/2010 | Yabuuchi et al. | 165/63 |
| 2010/0319377 | A1* | 12/2010 | Moriwaki et al. | 62/238.6 |

FOREIGN PATENT DOCUMENTS

| | | | |
|---|---|---|---|
| JP | 06-221699 | A | 8/1994 |
| JP | 07-269964 | A | 10/1995 |
| JP | 11-182951 | A | 7/1999 |
| JP | 2004-077021 | A | 3/2004 |
| JP | 2005-133999 | A | 5/2005 |
| JP | 2007-085729 | A | 4/2007 |
| JP | 2010-197033 | A | 9/2010 |
| JP | 2011-094871 | A | 5/2011 |
| WO | 2009-098751 | A1 | 4/2008 |

OTHER PUBLICATIONS

Office Action mailed May 7, 2015 issued in corresponding JP patent application No. 2013-554986 (and English translation).
International Search Report of the International Searching Authority mailed Apr. 24, 2012 for the corresponding international application No. PCT/JP2012/000419 (and English translation).
Extended European Search Report issued Mar. 3, 2016 in the corresponding EP application No. 12866916.5.
Japanese Office Action ( Decision of Refusal) mailed on Jul. 12, 2016 in the corresponding JP application No. JP2013-554986. (English translation attached).

* cited by examiner

REFRIGERANT CHARGING METHOD FOR AIR-CONDITIONING APPARATUS AND AIR-CONDITIONING APPARATUS

CROSS REFERENCE TO RELATED APPLICATION

This application is a U.S. national stage application of PCT/JP2012/000419 filed on Jan. 24, 2012, the contents of which are incorporated herein by reference.

TECHNICAL FIELD

The present invention relates to a refrigerant charging method for an air-conditioning apparatus that is applied to, for example, a multi-air-conditioning apparatus for a building, and also relates to an air-conditioning apparatus charged with a refrigerant by the method.

BACKGROUND

There has been a two-level air-conditioning apparatus including a first refrigeration cycle at a high level and a second refrigeration cycle at a low level, and having an intermediate heat exchanger for exchanging heat between refrigerants, which circulate through the respective refrigeration cycles, with counterflow (for example, see Patent Literature 1). In a technology described in Patent Literature 1, zeotropic refrigerant mixtures having different temperature glides are employed for the refrigerants, which circulate through the respective first and second refrigeration cycles.

Also, there has been proposed an air-conditioning apparatus that controls the condensing temperature and the evaporating temperature of a refrigerant with regard to a phenomenon in which the circulation composition of the refrigerant is changed in accordance with the amount of the liquid refrigerant stored in an accumulator, and hence that can increase heat exchanging efficiency (for example, see Patent Literature 2).

Further, there has been proposed a multi-air-conditioning apparatus for a building (for example, see Patent Literature 3). The multi-air-conditioning apparatus includes a first refrigeration cycle and a second refrigeration cycle, and can generate hot water by exchanging heat between the refrigerants, which circulate through the respective first and second refrigeration cycles.

Patent Literature

Patent Literature 1: Japanese Unexamined Patent Application Publication No. 7-269964 (for example, see page 6 of the specification and FIG. 3)

Patent Literature 2: Japanese Unexamined Patent Application Publication No. 11-182951 (for example, see pages 5 and 6 of the specification and FIG. 1)

Patent Literature 3: WO 2009/098751 (for example, see page 5 of the specification and FIG. 1)

The technology described in Patent Literature 1 can increase the heat exchanging efficiency because the refrigerants supplied to the intermediate heat exchanger form counterflow. However, the technology does not increase the heat exchanging efficiency in view of the temperature glides of the zeotropic refrigerant mixtures in the ph line diagram. That is, the technology described in Patent Literature 1 has a problem in which the heat exchanging efficiency is decreased because the temperature glide of the zeotropic refrigerant mixture flowing through the first refrigeration cycle is significantly different from the temperature glide of the zeotropic refrigerant mixture flowing through the second refrigeration cycle.

The technology described in Patent Literature 2 can increase the heat exchanging efficiency due to the technology takes into account that the circulation composition of the refrigerant is changed. However, the technology does not increase the heat exchanging efficiency in view of the temperature glides of the zeotropic refrigerant mixtures in the ph line diagram. That is, the technology described in Patent Literature 2 does not take into account that the heat exchanging efficiency is decreased if the temperature glides of the zeotropic refrigerant mixtures in the different refrigeration cycles are different from each other. Thus, the technology has a problem in which the heat exchanging efficiency is decreased if the zeotropic refrigerant mixtures are employed as the refrigerants.

In the technology described in Patent Literature 3, the refrigerants circulating through the respective first and second refrigeration cycles are not even the zeotropic refrigerant mixtures. Hence, the problem in which the heat exchanging efficiency is decreased because of the temperature glides of the zeotropic refrigerant mixtures in the ph line diagram does not occur. That is, since the technology described in Patent Literature 3 does not increase the heat exchanging efficiency in view of the temperature glides of the zeotropic refrigerant mixtures in the ph line diagram, the technology has the problem in which the heat exchanging efficiency is decreased if the zeotropic refrigerant mixtures are employed as the refrigerants.

SUMMARY

The present invention is made to address the above-described problems, and an object of the invention is to provide a refrigerant charging method for an air-conditioning apparatus that can increase the heat exchanging efficiency.

A refrigerant charging method for an air-conditioning apparatus according to the invention is provided. The air-conditioning apparatus includes a first refrigeration cycle, in which a first compressor, a heat-source-side heat exchanger, a first expansion device, a first intermediate heat exchanger, and a first passage of a heat exchanger for heating are connected through a first refrigerant pipe, and a second refrigeration cycle, in which a second compressor, a second passage of the heat exchanger for heating, a second expansion device, and a second intermediate heat exchanger are connected through a second refrigerant pipe. A first refrigerant which is charged to the first refrigeration cycle and a second refrigerant which is charged to the second refrigeration cycle are each a zeotropic refrigerant mixture having different saturated gas temperatures and saturated liquid temperatures under the same pressure. Heat of the first refrigerant and heat of the second refrigerant are exchanged by the heat exchanger for heating. The heat exchanger for heating is connected to the first refrigerant pipe and the second refrigerant pipe so that the first refrigerant which is supplied to the first passage of the heat exchanger for heating and the second refrigerant which is supplied to the second passage form counterflow. The refrigerant charging method includes, when a first temperature difference is a difference between a saturated gas temperature of the first refrigerant at an inlet side and a saturated liquid temperature of the first refrigerant at an outlet side in the heat exchanger for heating, and when a second temperature difference is a difference between a saturated gas temperature of the second refrigerant at an outlet side and a temperature of the second refrigerant at an inlet side in the heat exchanger for heating, holding a difference between the first temperature difference and the second temperature difference in a predetermined value or less by charging the second refrigerant to the second refrigeration cycle so that a plurality of single refrigerants forming the second refrigerant have a predetermined mixing ratio.

With the refrigerant charging method for the air-conditioning apparatus according to the invention, by charging the second refrigerant to the second refrigeration cycle so that the plurality of single refrigerants forming the second refrigerant have the predetermined mixing ratio, then the difference between the first temperature difference and the second temperature difference is held in the predetermined value or less. Accordingly, the heat exchanging efficiency between the first refrigerant and the second refrigerant flowing into the heat exchanger for heating can be increased.

Also, with the refrigerant charging method for the air-conditioning apparatus according to the invention, since the heat exchanging efficiency can be increased, energy can be saved by the amount of the increase in heat exchanging efficiency.

DETAILED DESCRIPTION

Embodiment 1

Figure 1:
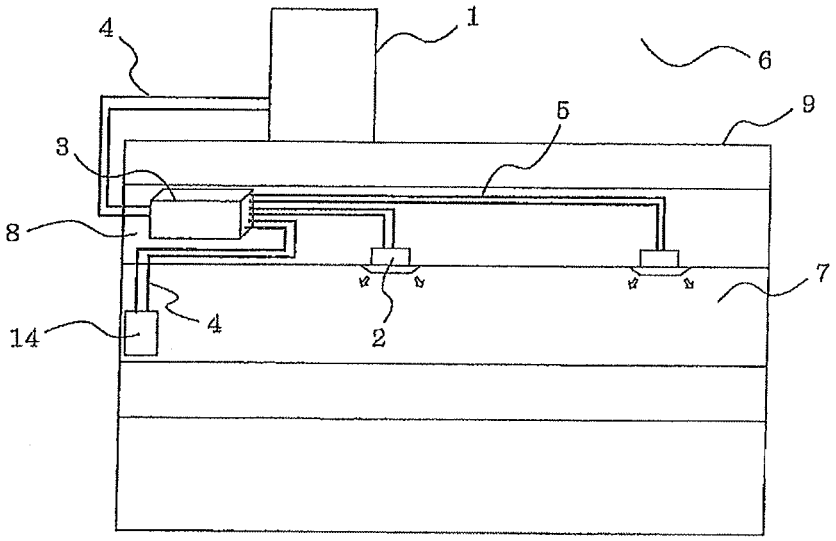
FIG. 1 is a schematic view showing an installation example of an air-conditioning apparatus according to Embodiment 1 of the invention.

FIG. 1 is a schematic view showing an installation example of an air-conditioning apparatus according to Embodiment 1. The installation example of the air-conditioning apparatus is described with reference to FIG. 1. In the drawings in addition to FIG. 1, the relationship of sizes of respective components may differ from the relationship of sizes of actual components.

In FIG. 1, the air-conditioning apparatus according to Embodiment 1 includes an outdoor unit 1, a plurality of indoor units 2, a heat medium relay unit 3 arranged between the outdoor unit 1 and the indoor units 2, and a hot-water supplying device 14.

The outdoor unit 1 is connected to the heat medium relay unit 3 through refrigerant pipes 4 that allow a first heat-source-side refrigerant to flow therethrough. The heat medium relay unit 3 is connected to the indoor units 2 through pipes (heat medium pipes) 5 that allow a first heat medium to flow therethrough. Also, the hot-water supplying device 14 is connected to the heat medium relay unit 3 through the refrigerant pipes 4 that allow the first heat-source-side refrigerant to flow therethrough.

The hot-water supplying device 14 is connected to a hot-water storage tank 24, which will be described later. Heating energy generated by the outdoor unit 1 is used for heating water stored in the hot-water storage tank 24.

The outdoor unit 1 is typically arranged in an outdoor space 6, which is a space outside a structure 9, such as a building (for example, a rooftop). The outdoor unit 1 supplies cooling energy or heating energy to each indoor unit 2 through the heat medium relay unit 3. The indoor unit 2 is arranged at a position, at which the indoor unit 2 can supply cooling air or heating air to an indoor space 7, which is a space inside the structure 9 (for example, a living room). The indoor unit 2 supplies the cooling air or the heating air to the indoor space 7, which becomes an air-conditioned space.

The heat medium relay unit 3 is configured to be installed at a position different from positions of the outdoor space 6 and the indoor space 7, and to have a housing different from housings of the outdoor unit 1 and the indoor units 2. The heat medium relay unit 3 is connected to the outdoor unit 1 through the refrigerant pipes 4, and is connected to the indoor units 2 through the heat medium pipes 5. The heat medium relay unit 3 transfers the cooling energy or the heating energy supplied from the outdoor unit 1 to the indoor units 2.

The hot-water supplying device 14 supplies hot water to a load side of hot-water supply or the like. FIG. 1 illustrates an example in which the hot-water supplying device 14 is installed in the indoor space 7; however, it is not limited thereto. For example, the hot-water supplying device 14 may be preferably installed at any position in the structure 9.

As shown in FIG. 1, in the air-conditioning apparatus according to Embodiment 1, the outdoor unit 1 is connected to the heat medium relay unit 3 through the refrigerant pipes 4, and the heat medium relay unit 3 is connected to the hot-water supplying device 14 through the refrigerant pipes 4. Also, the heat medium relay unit 3 is connected to each of the indoor units 2 through the heat medium pipes 5.

As described above, the air-conditioning apparatus according to Embodiment 1 is configured such that the respective units (the outdoor unit 1, the indoor units 2, the hot-water supplying device 14, and the heat medium relay unit 3) are connected through the refrigerant pipes 4 and the heat medium pipes 5, and hence facilitates the installation thereof.

FIG. 1 illustrates an example state in which the heat medium relay unit 3 is installed in a space, such as a space above a ceiling, the space which is inside the structure 9 but is different from the indoor space 7 (hereinafter, such a space is merely referred to as space 8). Otherwise, the heat medium relay unit 3 may be installed in a common space, in which, for example, an elevator is arranged. Also, FIG. 1 illustrates an example in which the indoor units 2 are each ceiling cassette type; however, it is not limited thereto. The indoor units 2 may be of any type, such as ceiling concealed type or ceiling suspended type, as long as the heating air or the cooling air can be output to the indoor space 7 directly, or through a duct or the like.

FIG. 1 illustrates an example in which the outdoor unit 1 is installed in the outdoor space 6; however, it is not limited thereto. For example, the outdoor unit 1 may be installed in a surrounded space, such as a machine room provided with a ventilating opening, may be installed in the structure 9 as long as waste heat can be exhausted to the outside of the structure 9 through an exhaust duct, or may be installed in the structure 9 if a water-cooled outdoor unit 1 is used. Even if the outdoor unit 1 is installed at any of the above-described locations, problems do not particularly arise.

Also, the heat medium relay unit 3 may be installed near the outdoor unit 1. However, if the distance from the heat medium relay unit 3 to each of the indoor units 2 is too large, the sending power for the first heat medium becomes markedly large, and hence it has to be noted that the energy saving effect may be decreased. Further, the number of connected units including the outdoor unit 1, the indoor units 2, and the heat medium relay unit 3 is not limited to the number illustrated in FIG. 1. The number of units may be determined in accordance with the structure 9 in which the air-conditioning apparatus according to Embodiment 1 is installed.

Figure 2:
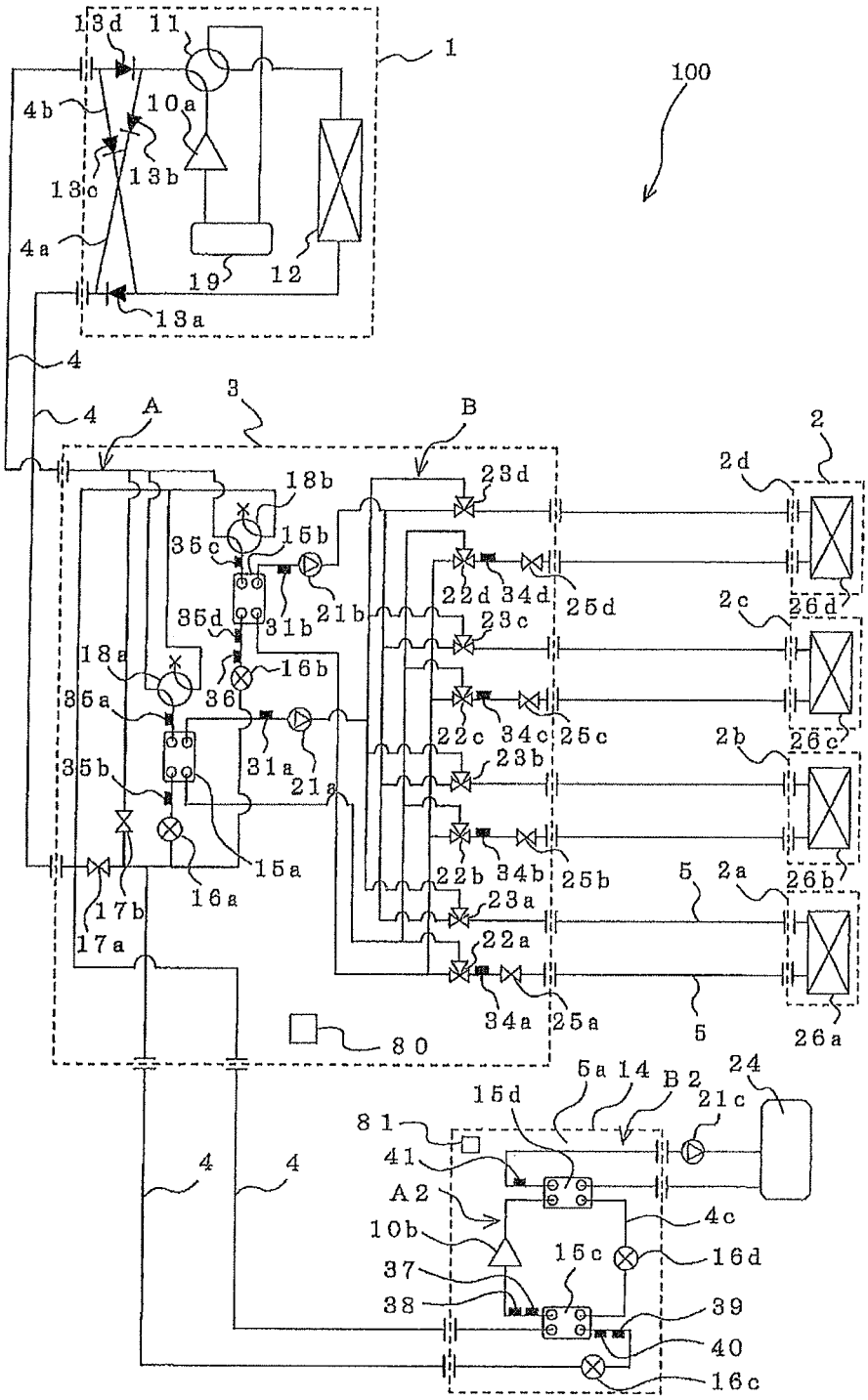
FIG. 2 is a drawing illustrates a circuit configuration example of the air-conditioning apparatus according to Embodiment 1 of the invention.

FIG. 2 is a drawing illustrates a circuit configuration example of the air-conditioning apparatus (hereinafter, referred to as air-conditioning apparatus 100) according to Embodiment 1 of the invention. A detailed configuration of the air-conditioning apparatus 100 is described with reference to FIG. 2.

As shown in FIG. 2, intermediate heat exchangers 15*a* and 15*b* or the like are connected to the outdoor unit 1 and the heat medium relay unit 3 through the refrigerant pipes 4, and hence a first refrigeration cycle is formed. The intermediate heat exchangers 15*a* and 15*b* or the like are connected to the heat medium relay unit 3 and the indoor units 2 through the heat medium pipes 5, and hence a first heat medium cycle is formed.

Also, a heat exchanger for heating 15*c* or the like is connected to the hot-water supplying device 14 through a refrigerant pipe 4*c*, and hence a second refrigeration cycle is formed. An intermediate heat exchanger 15*d* or the like is connected to the hot-water supplying device 14 and the hot-water storage tank 24 through a heat medium pipe 5*a*, and hence a second heat medium cycle is formed.

[Outdoor Unit 1]

The outdoor unit 1 includes a compressor 10*a*, a first refrigerant flow switching device 11 such as a four-way valve, a heat-source-side heat exchanger 12, and an accumulator 19, which are connected through the refrigerant pipes 4. The outdoor unit 1 also includes a first connection pipe 4*a*, a second connection pipe 4*b*, and check valves 13*a*, 13*b*, 13*c*, and 13*d*. Since the first connection pipe 4*a*, the second connection pipe 4*b*, and the check valves 13*a*, 13*b*, 13*c*, and 13*d* are provided, the flow of the first heat-source-side refrigerant, which flows into the heat medium relay unit 3, can be set in a constant direction in any operation requested by the indoor unit 2.

The compressor 10*a* sucks the first heat-source-side refrigerant, compresses the first heat-source-side refrigerant, and hence brings the first heat-source-side refrigerant into a high-temperature high-pressure state. The compressor 10*a* may be formed of, for example, an inverter compressor the capacity of which can be controlled. The discharge side of the compressor 10*a* is connected to the first refrigerant flow switching device 11, and the suction side is connected to the accumulator 19. The compressor 10*a* corresponds to a first compressor.

The first refrigerant flow switching device 11 switches the flow of the refrigerant between the flow of the first heat-source-side refrigerant in a heating operation (in a heating only operation mode and in a heating main operation mode) and the flow of the first heat-source-side refrigerant in a cooling operation (in a cooling only operation mode and in a cooling main operation mode). FIG. 2 illustrates a state in which the first refrigerant flow switching device 11 connects the discharge side of the compressor 10*a* with the first connection pipe 4*a*, and also connects the heat-source-side heat exchanger 12 with the accumulator 19.

The heat-source-side heat exchanger 12 functions as an evaporator in a heating operation, and functions as a condenser (or a radiator) in a cooling operation. The heat-source-side heat exchanger 12 exchanges heat between the air, which is supplied from an air-sending device such as a fan (not shown), and a refrigerant, and hence evaporates and gasifies the refrigerant, or condenses and liquefies the refrigerant. One end of the heat-source-side heat exchanger 12 is connected to the first refrigerant flow switching device 11, and the other end is connected to the refrigerant pipe 4 provided with the check valve 13*a*.

The accumulator 19 stores an excessive refrigerant. One end of the accumulator 19 is connected to the first refrigerant flow switching device 11, and the other end is connected to the suction side of the compressor 10*a*.

The check valve 13*a* is provided to the refrigerant pipe 4 arranged between the heat-source-side heat exchanger 12 and the heat medium relay unit 3. The check valve 13*a* allows the refrigerant to flow only in a predetermined direction (a direction from the outdoor unit 1 to the heat medium relay unit 3). The check valve 13*b* is provided to the first connection pipe 4*a*. The check valve 13*b* causes the refrigerant discharged from the compressor 10*a* to flow to the heat medium relay unit 3 in the heating operation. The check valve 13*c* is provided to the second connection pipe 4*b*. The check valve 13*c* causes the refrigerant returned from the heat medium relay unit 3 to flow to the suction side of the compressor 10*a* in the heating operation. The check valve 13*d* is provided to the refrigerant pipe 4 arranged between the heat medium relay unit 3 and the first refrigerant flow switching device 11. The check valve 13*d* allows the refrigerant to flow only in a predetermined direction (a direction from the heat medium relay unit 3 to the outdoor unit 1).

The first connection pipe 4*a* connects the refrigerant pipe 4 arranged between the first refrigerant flow switching device 11 and the check valve 13*d* with the refrigerant pipe 4 arranged between the check valve 13*a* and the heat medium relay unit 3, in the outdoor unit 1.

The second connection pipe 4*b* connects the refrigerant pipe 4 arranged between the check valve 13*d* and the heat medium relay unit 3 with the refrigerant pipe 4 arranged between the heat-source-side heat exchanger 12 and the check valve 13*a*, in the outdoor unit 1.

The air-conditioning apparatus 100 shown in FIG. 2 is provided with the first connection pipe 4*a*, the second connection pipe 4*b*, and the check valves 13*a* to 13*d*; however, it is not limited thereto. That is, the first connection pipe 4*a*, the second connection pipe 4*b*, and the check valves 13*a* to 13*d* do not have to be provided in the air-conditioning apparatus 100.

[Indoor Unit 2]

The indoor units 2 are provided with respective use-side heat exchangers 26. The use-side heat exchangers 26 are connected to respective heat medium flow control devices 25 and respective second heat medium flow switching devices 23 of the heat medium relay unit 3 through the heat medium pipes 5. The use-side heat exchangers 26 exchange heat between the air supplied from an air-sending device such as a fan (not shown) and the first heat medium, and hence generate the heating air or the cooling air to be supplied to the indoor space 7.

FIG. 2 illustrates an example in which four indoor units 2 are connected to the heat medium relay unit 3. The four indoor units 2 are illustrated as an indoor unit 2*a*, an indoor unit 2*b*, an indoor unit 2*c*, and an indoor unit 2*d* in that order from the lower side of FIG. 2. Also, the use-side heat exchangers 26 are illustrated as a use-side heat exchanger 26*a*, a use-side heat exchanger 26*b*, a use-side heat exchanger 26*c*, and a use-side heat exchanger 26*d* in that order from the lower side of FIG. 2. The use-side heat exchangers 26*a* to 26*d* respectively correspond to the indoor units 2*a* to 2*d*. Similarly to FIG. 1, the number of connected indoor units 2 is not limited to four as shown in FIG. 2.

[Heat Medium Relay Unit 3]

The heat medium relay unit 3 includes two intermediate heat exchangers 15, two expansion devices 16, two opening and closing devices 17, two second refrigerant flow switching devices 18, two pumps 21, four first heat medium flow switching devices 22, the four second heat medium flow switching devices 23, and the four heat medium flow control devices 25 mounted thereon. Also, the heat medium relay unit 3 is provided with various detection devices (two first temperature sensors 31, four second temperature sensors 34, four third temperature sensors 35, and a pressure sensor 36).

The two intermediate heat exchangers 15 (the intermediate heat exchanger 15*a*, the intermediate heat exchanger 15*b*) function as condensers (radiators) or evaporators. The intermediate heat exchangers 15 exchange heat between the first heat-source-side refrigerant and the first heat medium, and transfer the cooling energy or the heating energy generated in the outdoor unit 1 and stored in the first heat-source-side refrigerant to the first heat medium. The intermediate heat exchanger 15*a* is provided between an expansion device 16*a* and a second refrigerant flow switching device 18*a* in a refrigerant circuit A, and is used for cooling the first heat medium in a cooling and heating mixed operation mode. Also, the intermediate heat exchanger 15*b* is provided between an expansion device 16*b* and a second refrigerant flow switching device 18*b* in the refrigerant circuit A, and is used for heating the first heat medium in the cooling and heating mixed operation mode. The intermediate heat exchangers 15*a* and 15*b* correspond to a first intermediate heat exchanger.

The two expansion devices 16 (the expansion device 16*a*, the expansion device 16*b*) have functions as pressure reducing valves or expansion valves. The expansion devices 16 reduce the pressure of the first heat-source-side refrigerant and hence expand the first heat-source-side refrigerant. The expansion device 16*a* is provided upstream of the intermediate heat exchanger 15*a* in the flow of the first heat-source-side refrigerant in the cooling operation. The expansion device 16*b* is provided upstream of the intermediate heat exchanger 15*b* in the flow of the first heat-source-side refrigerant in the cooling operation. The two expansion devices 16 may be formed of, for example, electronic expansion valves the opening degrees of which can be variably controlled. The expansion devices 16*a* and 16*b* correspond to a first expansion device.

The two opening and closing devices 17 (an opening and closing device 17*a*, an opening and closing device 17*b*) are formed of two-way valves or the like. The opening and closing devices 17 open and close the refrigerant pipes 4. The opening and closing device 17*a* is provided to the refrigerant pipe 4 at the inlet side of the first heat-source-side refrigerant. The opening and closing device 17*b* is provided to a pipe that connects the refrigerant pipe 4 at the inlet side with the refrigerant pipe 4 at the outlet side of the first heat-source-side refrigerant. The two second refrigerant flow switching devices 18 (the second refrigerant flow switching device 18*a*, the second refrigerant flow switching device 18*b*) are formed of four-way valves or the like. The second refrigerant flow switching devices 18 switch the flow of the first heat-source-side refrigerant in accordance with the operation mode. The second refrigerant flow switching device 18*a* is provided downstream of the intermediate heat exchanger 15*a* in the flow of the first heat-source-side refrigerant in the cooling operation. The second refrigerant flow switching device 18*b* is provided downstream of the intermediate heat exchanger 15*b* in the flow of the first heat-source-side refrigerant in the cooling operation.

The two pumps 21 (a pump 21*a*, a pump 21*b*) cause the first heat medium flowing through the heat medium pipes 5 to circulate. The pump 21*a* is provided to the heat medium pipe 5 arranged between the intermediate heat exchanger 15*a* and the second heat medium flow switching devices 23. The pump 21*b* is provided to the heat medium pipe 5 arranged between the intermediate heat exchanger 15*b* and the second heat medium flow switching devices 23. The two pumps 21 may be formed of pumps the capacities of which can be controlled.

The four first heat medium flow switching devices 22 (a first heat medium flow switching device 22*a* to a first heat medium flow switching device 22*d*) are formed of three-way valves or the like. The first heat medium flow switching devices 22 switch the passages of the first heat medium. The first heat medium flow switching devices 22 are provided by the number corresponding to the installation number of the indoor units 2 (in this case, four).

The first heat medium flow switching devices 22 are each provided at the outlet side of the heat medium passage of the corresponding use-side heat exchanger 26. To be more specific, the first heat medium flow switching devices 22 are each connected to the intermediate heat exchanger 15*a*, the intermediate heat exchanger 15*b*, and the corresponding heat medium flow control device 25.

The four second heat medium flow switching devices 23 (a second heat medium flow switching device 23*a* to a second heat medium flow switching device 23*d*) are formed of three-way valves or the like. The second heat medium flow switching devices 23 switch the passages of the first heat medium. The second heat medium flow switching devices 23 are provided by the number corresponding to the installation number of the indoor units 2 (in this case, four).

The second heat medium flow switching devices 23 are each provided at the inlet side of the passage of the first heat medium of the corresponding use-side heat exchanger 26. To be more specific, the second heat medium flow switching devices 23 are each connected to the intermediate heat exchanger 15*a*, the intermediate heat exchanger 15*b*, and the corresponding use-side heat exchanger 26.

The four heat medium flow control devices 25 (a heat medium flow control device 25*a* to a heat medium flow control device 25*d*) are formed of two-way valves or the like, the opening areas of which can be controlled. The heat medium flow control devices 25 each control the flow rate of the heat medium flowing through the heat medium pipe 5. The heat medium flow control devices 25 are provided by the number corresponding to the installation number of the indoor units 2 (in this case, four).

The heat medium flow control devices 25 are each provided at the outlet side of the heat medium passage of the corresponding use-side heat exchanger 26. To be more specific, one end of each heat medium flow control device 25 is connected to the corresponding use-side heat exchanger 26, and the other end is connected to the corresponding first heat medium flow switching device 22. Alternatively, the heat medium flow control devices 25 may be each provided at the inlet side of the passage of the first heat medium of the corresponding use-side heat exchanger 26.

The two first temperature sensors 31 (a first temperature sensor 31*a*, a first temperature sensor 31*b*) each detect the temperature of the first heat medium flowing out from the corresponding intermediate heat exchanger 15, that is, the temperature of the first heat medium at the outlet of the corresponding intermediate heat exchanger 15. The first temperature sensors 31 may be formed of, for example, thermistors.

The first temperature sensor 31*a* is provided to the heat medium pipe 5 at the inlet side of the pump 21*a*. The first temperature sensor 31*b* is provided to the heat medium pipe 5 at the inlet side of the pump 21*b*.

The four second temperature sensors 34 (a second temperature sensor 34*a* to a second temperature sensor 34*d*) are each arranged between the corresponding first heat medium flow switching device 22 and the corresponding heat medium flow control device 25, and each detect the temperature of the first heat medium flowing out from the corresponding use-side heat exchanger 26. The second temperature sensors 34 may be formed of, for example, thermistors.

The second temperature sensors 34 are provided by the number corresponding to the installation number of the indoor units 2 (in this case, four). Alternatively, the second temperature sensors 34 may be each provided to the passage arranged between the corresponding heat medium flow control device 25 and the corresponding use-side heat exchanger 26. Also, the heat medium flow control devices 25 may be each provided at the inlet side of the passage of the first heat medium of the corresponding use-side heat exchanger 26.

The four third temperature sensors 35 (a third temperature sensor 35*a* to a third temperature sensor 35*d*) are each provided at the inlet side or the outlet side of the first heat-source-side refrigerant of the corresponding intermediate heat exchanger 15, and each detect the temperature of the first heat-source-side refrigerant flowing into the corresponding intermediate heat exchanger 15 or the temperature of the first heat-source-side refrigerant flowing out from the corresponding intermediate heat exchanger 15. The third temperature sensors 35 may be formed of, for example, thermistors.

The third temperature sensor 35*a* is provided between the intermediate heat exchanger 15*a* and the second refrigerant flow switching device 18*a*. The third temperature sensor 35*b* is provided between the intermediate heat exchanger 15*a* and the expansion device 16*a*. The third temperature sensor 35*c* is provided between the intermediate heat exchanger 15*b* and the second refrigerant flow switching device 18*b*. The third temperature sensor 35*d* is provided between the intermediate heat exchanger 15*b* and the expansion device 16*b*.

The pressure sensor 36 is provided between the intermediate heat exchanger 15*b* and the expansion device 16*b* similarly to the arrangement position of the third temperature sensor 35*d*. The pressure sensor 36 detects the pressure of the first heat-source-side refrigerant flowing between the intermediate heat exchanger 15*b* and the expansion device 16*b*.

The heat medium pipes 5 through which the heat medium flows include the heat medium pipe 5 connected to the intermediate heat exchanger 15*a* and the heat medium pipe 5 connected to the intermediate heat exchanger 15*b*. The heat medium pipes 5 are branched in accordance with the number of the indoor units 2 connected to the heat medium relay unit 3 (in this case, four branches). The heat medium pipes 5 are connected at the first heat medium flow switching devices 22 and the second heat medium flow switching devices 23. By controlling the first heat medium flow switching devices 22 and the second heat medium flow switching devices 23, it is determined whether the heat medium from the intermediate heat exchanger 15*a* is caused to flow into the use-side heat exchangers 26 or the heat medium from the intermediate heat exchanger 15*b* is caused to flow into the use-side heat exchangers 26.

[Hot-water Supplying Device 14, Pump 21*c*, Hot-water Storage Tank 24]

The hot-water supplying device 14 transfers the heating energy of the first heat-source-side refrigerant to a second heat-source-side refrigerant, and further transfers the heating energy of the second heat-source-side refrigerant to a second heat medium.

The hot-water supplying device 14 includes a compressor 10*b* that compresses the second heat-source-side refrigerant, the intermediate heat exchanger 15*d* that functions as a condenser, an expansion device 16*d* that reduces the pressure of the second heat-source-side refrigerant, and the heat exchanger for heating 15*c* that functions as an evaporator, as configurations forming the second refrigeration cycle.

Also, the hot-water supplying device 14 includes an expansion device 16*c* that reduces the pressure of the first heat-source-side refrigerant, as a configuration forming part of the first refrigeration cycle.

Also, a pump 21*c* that sends the second heat medium, and a hot-water storage tank 24 that can store the second heat medium are connected to the hot-water supplying device 14, as configurations forming the second heat medium cycle.

Further, the hot-water supplying device 14 includes a second pressure sensor 37 that detects the pressure of the second heat-source-side refrigerant, a third pressure sensor 39 that detects the pressure of the first heat-source-side refrigerant, a fourth temperature sensor 38 that detects the temperature of the second heat-source-side refrigerant, a fifth temperature sensor 40 that detects the temperature of the first heat-source-side refrigerant, and a sixth temperature sensor 41 that detects the temperature of the second heat medium.

As shown in FIG. 2, the air-conditioning apparatus 100 is not limited to the configuration including the single hot-water supplying device 14. A plurality of the hot-water supplying devices 14 may be provided. If the plurality of hot-water supplying devices 14 are provided in the air-conditioning apparatus 100, the hot-water supplying devices 14 may be connected to the heat medium relay unit 3 in parallel through the refrigerant pipes 4.

The compressor 10*b* sucks the second heat-source-side refrigerant, compresses the second heat-source-side refrigerant, and hence brings the second heat-source-side refrigerant into a high-temperature high-pressure state. The compressor 10*b* may be formed of, for example, an inverter compressor the capacity of which can be controlled. The discharge side of the compressor 10*b* is connected to the intermediate heat exchanger 15*d*, and the suction side is connected to the heat exchanger for heating 15*c*. The compressor 10*b* corresponds to a second compressor.

The heat exchanger for heating 15*c* functions as an evaporator. The heat exchanger for heating 15*c* exchanges heat between the first heat-source-side refrigerant and the second heat-source-side refrigerant, and hence transfers the heating energy generated by the outdoor unit 1 and stored in the first heat-source-side refrigerant to the second heat-source-side refrigerant. One of ends at the second heat source side of the heat exchanger for heating 15*c* is connected to the suction side of the compressor 10*b*, and the other end is connected to the expansion device 16*d*.

The heat exchanger for heating 15*c* is connected to the refrigerant pipe 4 and the refrigerant pipe 4*c* so that the flowing direction of the first heat-source-side refrigerant and the flowing direction of the second heat-source-side refrigerant in the heat exchanger for heating 15*c* form counterflow in any operation mode. Accordingly, the heat exchanging efficiency in the heat exchanger for heating 15*c* is increased.

The expansion device 16*d* has a function as a pressure reducing valve and an expansion valve. The expansion device 16*d* reduces the pressure of the second heat-source-side refrigerant to expand the second heat-source-side refrigerant. One end of the expansion device 16*d* is connected to the intermediate heat exchanger 15*d*, and the other end is connected to the heat exchanger for heating 15*c*. The expansion device 16*d* may be provided with, for example, a stepping motor, so that the opening degree thereof can be adjusted. The expansion device 16*c* corresponds to the first expansion device, similarly to the expansion devices 16*a* and 16*b*.

The intermediate heat exchanger 15*d* functions as a condenser (a radiator). The intermediate heat exchanger 15*d* exchanges heat between the second heat-source-side refrigerant and the second heat medium, and hence transfers heating energy, which is generated by the hot-water supplying device 14 and stored in the second heat-source-side refrigerant, to the second heat medium. One of ends at the second heat source side of the intermediate heat exchanger 15*d* is connected to the discharge side of the compressor 10*b*, and the other end is connected to the expansion device 16*d*. The intermediate heat exchanger 15*d* corresponds to a second intermediate heat exchanger.

The expansion device 16*c* has a function as a pressure reducing valve and an expansion valve. The expansion device 16*c* reduces the pressure of the first heat-source-side refrigerant to expand the first heat-source-side refrigerant. The expansion device 16*c* is located downstream of the heat exchanger for heating 15*c* in the flow of the first heat-source-side refrigerant in a heating only operation, a heating main operation, and a cooling main operation. The expansion device 16*c* may be provided with, for example, a stepping motor, so that the opening degree thereof can be adjusted. The expansion device 16*c* corresponds to the first expansion device.

The pump 21*c* circulates the second heat medium flowing through the heat medium pipe 5*a*. The pump 21*c* is provided to the heat medium pipe 5*a* arranged between the intermediate heat exchanger 15*d* and the hot-water storage tank 24. The pump 21*c* may be formed of a pump the capacity of which can be controlled.

The hot-water storage tank 24 stores the second heat medium flowing through the heat medium pipe 5*a*. One end of the hot-water storage tank 24 is connected to the discharge side of the pump 21*c*, and the other end is connected to the intermediate heat exchanger 15*d*.

The second pressure sensor 37 detects the pressure of the second heat-source-side refrigerant flowing out from the heat exchanger for heating 15*c*. The second pressure sensor 37 is provided between the heat exchanger for heating 15*c* and the suction side of the compressor 10*b*, similarly to the arrangement position of the fourth temperature sensor 38.

The third pressure sensor 39 detects the pressure of the first heat-source-side refrigerant flowing out from the heat exchanger for heating 15*c*. The third pressure sensor 39 is provided downstream of the heat exchanger for heating 15*c*, similarly to the arrangement position of the fifth temperature sensor 40.

The fourth temperature sensor 38 detects the temperature of the second heat-source-side refrigerant flowing out from the heat exchanger for heating 15*c*. The fourth temperature sensor 38 is provided between the heat exchanger for heating 15*c* and the suction side of the compressor 10*b*, similarly to the arrangement position of the second pressure sensor 37.

The fifth temperature sensor 40 detects the temperature of the first heat-source-side refrigerant flowing out from the heat exchanger for heating 15*c*. The fifth temperature sensor 40 is provided downstream of the heat exchanger for heating 15*c*, similarly to the arrangement position of the third pressure sensor 39. The sixth temperature sensor 41 detects the temperature of the second heat medium flowing out from the intermediate heat exchanger 15*d*. The sixth temperature sensor 41 is provided between the intermediate heat exchanger 15*d* and the suction side of the pump 21*c*.

The fourth temperature sensor 38, the fifth temperature sensor 40, and the sixth temperature sensor 41 may be formed of, for example, thermistors.

[First Controller 80 and Second Controller 81]

A first controller 80 and a second controller 81 are formed of, for example, microcomputers. The first controller 80 and the second controller 81 integrally control operation of the compressors 10*a* and 10*b*, and other devices, on the basis of information (temperature information, pressure information) detected by the various detection devices of the heat medium relay unit 3, information detected by the various detection devices of the hot-water supplying device 14, and an instruction from a remote controller, and are capable of executing various operation modes (described later). The first controller 80 and the second controller 81 mutually send and receive information, and hence are capable of cooperative control.

To be specific, detection results of the first temperature sensor 31, the second temperature sensor 34, the third temperature sensor 35, and the pressure sensor 36 are output to the first controller 80, and detection results of the fourth temperature sensor 38, the fifth temperature sensor 40, the sixth temperature sensor 41, the second pressure sensor 37, and the third pressure sensor 39 are output to the second controller 81. The first controller 80 and the second controller 81 mutually send and receive the detection results output to the first controller 80 and the detection results output to the second controller 81, and thus integrally control the following operations.

That is, the first controller 80 integrally controls, for example, the driving frequency of the compressor 10*a*, the rotation speed (including ON/OFF) of the air-sending device (not shown) arranged at the heat-source-side heat exchanger 12, the opening degrees of the expansion devices 16, the opening degrees of the opening and closing devices 17, switching of the first refrigerant flow switching device 11 and the second refrigerant flow switching devices 18, the driving frequencies of the pumps 21, switching of the first heat medium flow switching devices 22, switching of the second heat medium flow switching devices 23, and the opening degrees of the heat medium flow control devices 25. Also, the second controller 81 integrally controls, for example, the driving frequency of the compressor 10*b*, and the opening degrees of the expansion devices 16*c* and 16*d*.

The arrangement position of the first controller 80 is described as the position in the heat medium relay unit 3 in FIG. 2; however, it is not limited thereto. For example, the first controller 80 may be provided for each unit, or may be provided in the outdoor unit 1. Also, the arrangement position of the second controller 81 may be preferably in, the hot-water supplying device 14 as shown in FIG. 2. The first controller 80 and the second controller 81 are connected so that the first controller 80 and the second controller 81 can make communication in a wired or wireless manner and hence can are capable of cooperative control.

In the air-conditioning apparatus 100, the compressor 10*a*, the first refrigerant flow switching device 11, the heat-source-side heat exchanger 12, the opening and closing devices 17, the second refrigerant flow switching devices 18, the first heat-source-side refrigerant passages of the intermediate heat exchangers 15 and the heat exchanger for heating 15*c*, the expansion devices 16, the expansion device 16*c*, and the accumulator 19 are connected through the refrigerant pipes 4 and thus the refrigerant circuit A is formed.

Also, the first heat medium passages of the intermediate heat exchangers 15, the pumps 21, the first heat medium flow switching devices 22, the heat medium flow control devices 25, the use-side heat exchangers 26, and the second heat medium flow switching devices 23 are connected through the heat medium pipes 5, and thus a heat medium circuit B is formed.

The plurality of use-side heat exchangers 26 are connected in parallel to each other to each of the intermediate heat exchangers 15, and thus the heat medium circuit B has a plurality of systems.

Also, the compressor 10*b*, the second heat-source-side refrigerant passage of the heat exchanger for heating 15*c*, the second heat-source-side refrigerant passage of the intermediate heat exchanger 15*d*, and the expansion device 16*d* are connected through the refrigerant pipe 4*c*, and thus a refrigerant circuit A2 is formed.

Further, the pump 21*c*, the hot-water storage tank 24, and the second heat medium passage of the intermediate heat exchanger 15*d* are connected through the heat medium pipe 5*a*, and thus a heat medium circuit B2 is formed.

Thus, in the air-conditioning apparatus 100, the outdoor unit 1 and the heat medium relay unit 3 are connected through the intermediate heat exchanger 15*a* and the intermediate heat exchanger 15*b* provided in the heat medium relay unit 3, and the heat medium relay unit 3 and the indoor units 2 are also connected through the intermediate heat exchanger 15*a* and the intermediate heat exchanger 15*b*. Further, the heat medium relay unit 3 and the hot-water supplying device 14 are connected through the heat exchanger for heating 15*c* provided in the hot-water supplying device 14, and the hot-water supplying device 14 and the hot-water storage tank 24 are connected through the intermediate heat exchanger 15*d*.

That is, in the air-conditioning apparatus 100, heat is exchanged between the first heat-source-side refrigerant circulating through the refrigerant circuit A and the first heat medium circulating through the heat medium circuit B in the intermediate heat exchanger 15*a* and the intermediate heat exchanger 15*b*; heat is exchanged between the first heat-source-side refrigerant circulating through the refrigerant circuit A and the second heat-source-side refrigerant circulating through the refrigerant circuit A2 in the heat exchanger for heating 15*c*; and heat is exchanged between the second heat-source-side refrigerant circulating through the refrigerant circuit A2 and the second heat medium circulating through the heat medium circuit B2 in the intermediate heat exchanger 15*d*.

The passage of the first heat source refrigerant is independent from the passage of the second heat-source-side refrigerant, and do not meet each other. Also, the passage of the first heat medium is independent from the passage of the second heat medium, and do not meet each other.

Next, respective operation modes that are executed by the air-conditioning apparatus 100 are described. The air-conditioning apparatus 100 can cause each of the indoor units 2 to execute the cooling operation or the heating operation, in response to an instruction from the corresponding indoor unit 2. That is, the air-conditioning apparatus 100 is capable of causing all indoor units 2 to execute the same operation, and is capable of causing the indoor units 2 to execute different operations. In addition, the air-conditioning apparatus 100 is capable of heating the second heat medium stored in the hot-water storage tank 24 by using the heating energy of the first heat-source-side refrigerant in the first refrigeration cycle and the heating energy of the second heat-source-side refrigerant in the second refrigeration cycle.

The operation modes that are executed by the air-conditioning apparatus 100 include a cooling only operation mode in which all indoor units 2 being driven execute the cooling operation, a heating only operation mode in which all indoor units 2 being driven execute the heating operation, a cooling main operation mode with a cooling load being relatively large, and a heating main operation mode with a heating load being relatively large. The heating only operation mode, the heating main operation mode, and the cooling main operation mode include operating the hot-water supplying device 14 and hence heating the second heat medium. The respective operation modes are described below with regard to the flow of the heat-source-side refrigerant and the flow of the heat medium.

[Cooling Only Operation Mode]

Figure 3:
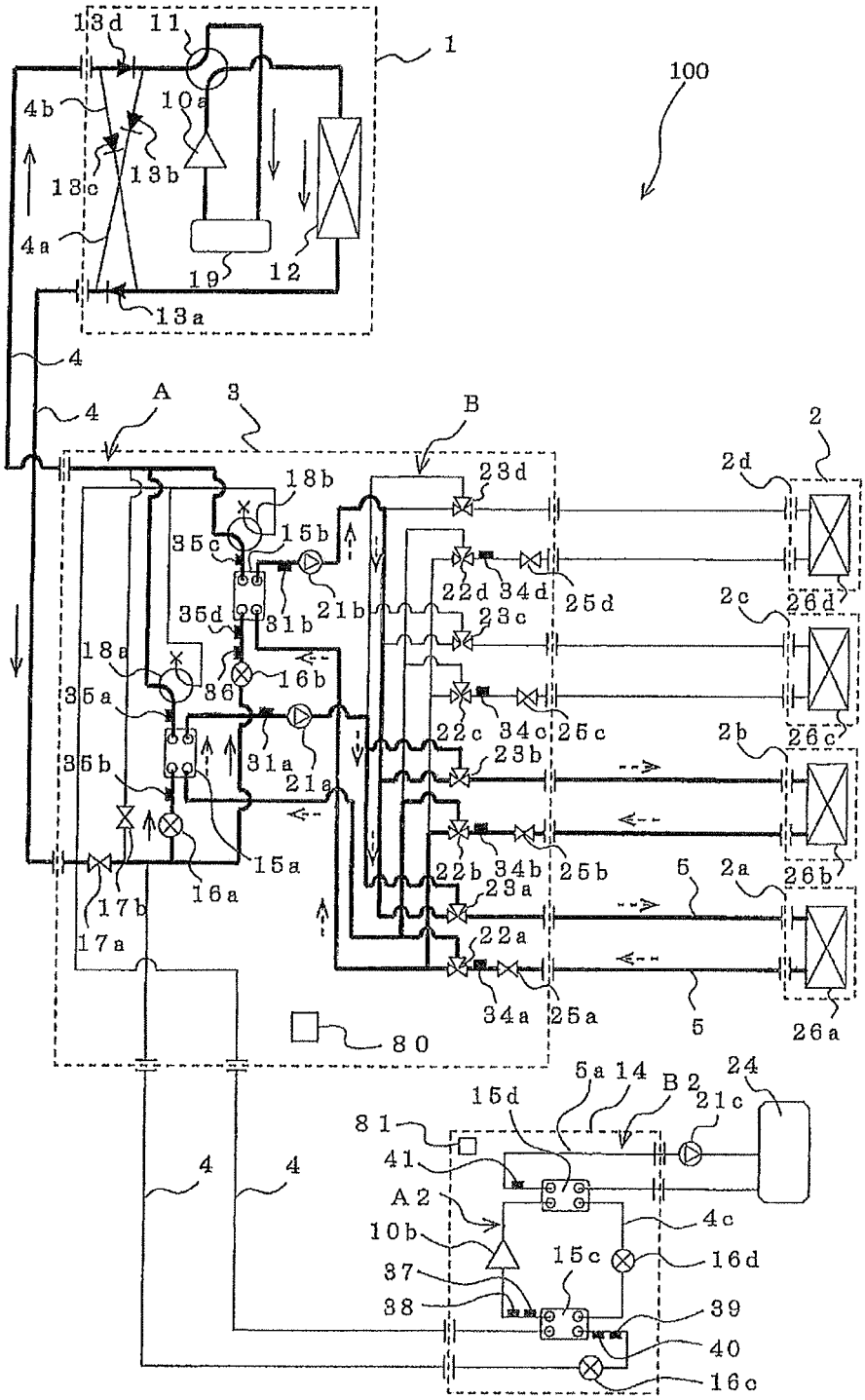
FIG. 3 is a drawing illustrates a flow of a refrigerant and a flow of a heat medium in a cooling only operation of the air-conditioning apparatus shown in FIG. 2.

FIG. 3 is a drawing illustrates the flow of the refrigerant and the flow of the heat medium in a cooling only operation of the air-conditioning apparatus 100 shown in FIG. 2. In FIG. 3, the cooling only operation mode is described with an example in which cooling loads are generated only in the use-side heat exchanger 26*a* and the use-side heat exchanger 26*b*. In FIG. 3, pipes depicted by thick lines express pipes through which the refrigerant (the first heat-source-side refrigerant) and the heat medium (the first heat medium) flow. Also, in FIG. 3, the flowing direction of the refrigerant is depicted by solid-line arrows and the flowing direction of the heat medium is depicted by broken-line arrows.

In the cooling only operation mode shown in FIG. 3, in the outdoor unit 1, the first refrigerant flow switching device 11 is switched to cause the heat-source-side refrigerant discharged from the compressor 10*a* to flow into the heat-source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are completely closed, so that the first heat medium circulates between each of the intermediate heat exchangers 15*a* and 15*b* and the use-side heat exchanger 26*a* and between each of the intermediate heat exchangers 15*a* and 15*b* and the use-side heat exchanger 26*b*. In the cooling only operation mode, the hot-water supplying device 14 is stopped.

First, the flow of the heat-source-side refrigerant in the refrigerant circuit A is described.

The low-temperature low-pressure first heat-source-side refrigerant is compressed by the compressor 10*a*, hence the first heat-source-side refrigerant becomes a high-temperature high-pressure gas refrigerant, and the gas refrigerant is discharged. The high-temperature high-pressure gas refrigerant discharged from the compressor 10*a* flows into the heat-source-side heat exchanger 12 through the first refrigerant flow switching device 11. Then, the gas refrigerant is condensed and liquefied while transferring heat to the outdoor air in the heat-source-side heat exchanger 12, and hence the gas refrigerant becomes a high-pressure liquid refrigerant. The high-pressure liquid refrigerant flowing out from the heat-source-side heat exchanger 12 passes through the check valve 13*a*, flows out from the outdoor unit 1, passes through the refrigerant pipe 4, and flows into the heat medium relay unit 3. The high-pressure liquid refrigerant flowing into the heat medium relay unit 3 passes through the opening and closing device 17*a*, then is branched to and expanded by the expansion device 16*a* and the expansion device 16*b*, and hence becomes a low-temperature low-pressure two-phase refrigerant.

The two-phase refrigerant flows into the intermediate heat exchanger 15*a* and intermediate heat exchanger 15*b* acting as evaporators, receives heat from the heat medium circulating through the heat medium circuit B, and hence becomes a low-temperature low-pressure gas refrigerant while cooling the heat medium. The gas refrigerant flowing out from the intermediate heat exchanger 15*a* and the intermediate heat exchanger 15*b* flows out from the heat medium relay unit 3 through the second refrigerant flow switching device 18*a* and the second refrigerant flow switching device 18*b*, passes through the refrigerant pipe 4, and flows again into the outdoor unit 1. The refrigerant flowing into the outdoor unit 1 passes through the check valve 13*d*, the first refrigerant flow switching device 11, and the accumulator 19, and then is sucked again to the compressor 10*a*.

At this time, the opening degree of the expansion device 16*a* is controlled so that superheat (the degree of superheat), which is obtained as the difference between the temperature detected by the third temperature sensor 35*a* and the temperature detected by the third temperature sensor 35*b*, is held constant. Similarly, the opening degree of the expansion device 16*b* is controlled so that superheat, which is obtained as the difference between the temperature detected by the third temperature sensor 35*c* and the temperature detected by the third temperature sensor 35*d*, is held constant. Also, the opening and closing device 17*a* is open, and the opening and closing device 17*b* is closed.

Next, the flow of the first heat medium in the heat medium circuit B is described.

In the cooling only operation mode, the cooling energy of the heat-source-side refrigerant is transferred to the heat medium by both the intermediate heat exchanger 15*a* and the intermediate heat exchanger 15*b*, and hence the cooled heat medium is caused to flow through the heat medium pipes 5 by the pump 21*a* and the pump 21*b*. The heat medium compressed by the pump 21*a* and the pump 21*b* and flowing out from the pump 21*a* and the pump 21*b* flows into the use-side heat exchanger 26*a* and the use-side heat exchanger 26*b* through the second heat medium flow switching device 23*a* and the second heat medium flow switching device 23*b*. Then, the heat medium receives heat from the indoor air in the use-side heat exchanger 26*a* and the use-side heat exchanger 26*b*, and thus cooling for the indoor space 7 is executed.

Then, the heat medium flows out from the use-side heat exchanger 26*a* and the use-side heat exchanger 26*b*, and flows into the heat medium flow control device 25*a* and the heat medium flow control device 25*b*. At this time, the flow rate of the heat medium is controlled to the flow rate required for accommodating the air conditioning load required in the indoor space by the action of the heat medium flow control device 25*a* and the heat medium flow control device 25*b*, and then the heat medium flows into the use-side heat exchanger 26*a* and the use-side heat exchanger 26*b*. The heat medium flowing out from the heat medium flow control device 25*a* and the heat medium flow control device 25*b* passes through the first heat medium flow switching device 22*a* and the first heat medium flow switching device 22*b*, flows into the intermediate heat exchanger 15*a* and the intermediate heat exchanger 15*b*, and is sucked again to the pump 21*a* and the pump 21*b*.

In the heat medium pipes 5 of the use-side heat exchangers 26, the heat medium flows in a direction in which the heat medium flows from the second heat medium flow switching devices 23 to the first heat medium flow switching devices 22 through the heat medium flow control devices 25. Also, the air conditioning load required for the indoor space 7 can be accommodated by controlling the difference between the temperature detected by the first temperature sensor 31*a* or the temperature detected by the first temperature sensor 31*b* and the temperature detected by the second temperature sensor 34 to be held at a target value. As the outlet temperatures of the intermediate heat exchangers 15, any of the temperatures of the first temperature sensor 31*a* and the first temperature sensor 31*b*, or the average value of these temperatures may be used. At this time, the first heat medium flow switching devices 22 and the second heat medium flow switching devices 23 have medium opening degrees so that the passages to both the intermediate heat exchanger 15*a* and the intermediate heat exchanger 15*b* are ensured.

When the cooling only operation mode is executed, the heat medium is not required to flow to the use-side heat exchanger 26 having no heat load (including thermo-off). The passage may be closed by the corresponding heat medium flow control device 25, so that the heat medium does not flow to the use-side heat exchanger 26. In FIG. 3, the heat medium is caused to flow to the use-side heat exchanger 26*a* and the use-side heat exchanger 26*b* because the use-side heat exchanger 26*a* and the use-side heat exchanger 26*b* have the heat loads. However, the use-side heat exchanger 26*c* or the use-side heat exchanger 26*d* does not have a heat load, and hence the corresponding heat medium flow control device 25*c* and heat medium flow control device 25*d* are completely closed. If heat loads are generated from the use-side heat exchanger 26*c* and the use-side heat exchanger 26*d*, the heat medium flow control device 25*c* and the heat medium flow control device 25*d* are opened to circulate the heat medium.

[Heating Only Operation Mode]

Figure 4:
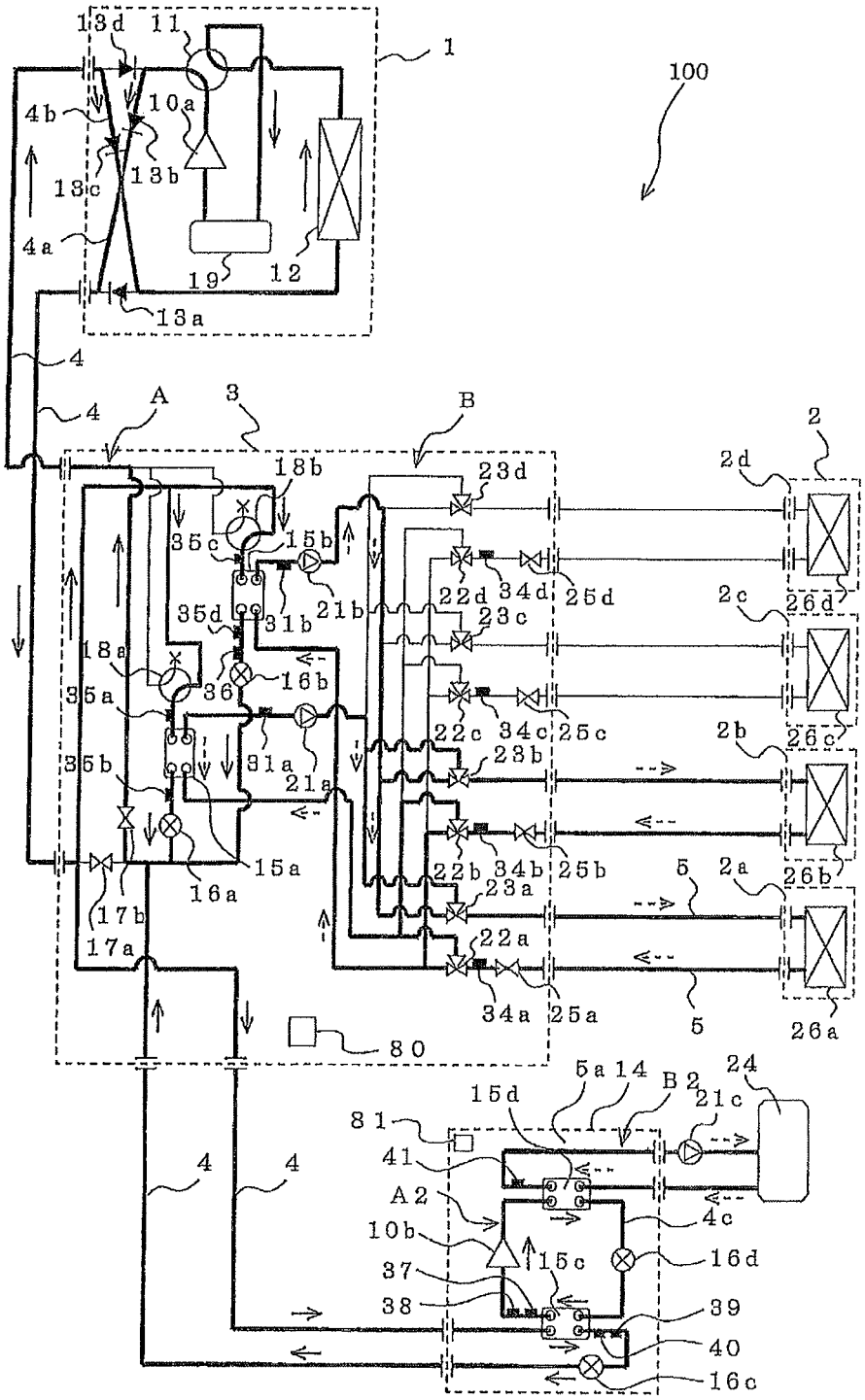
FIG. 4 is a drawing illustrates a flow of the refrigerant and a flow of the heat medium in a heating only operation of the air-conditioning apparatus shown in FIG. 2.

FIG. 4 is a drawing illustrates the flow of the refrigerant and the flow of the heat medium in a heating only operation of the air-conditioning apparatus 100 shown in FIG. 2. In FIG. 4, the heating only operation mode is described with an example in which heating loads are generated only in the use-side heat exchanger 26*a* and the use-side heat exchanger 26*b*. In FIG. 4, pipes depicted by thick lines express pipes through which the refrigerant (the first heat-source-side refrigerant and the second heat-source-side refrigerant) and the heat medium (the first heat medium and the second heat medium) flow. Also, in FIG. 4, the flowing direction of the refrigerant is depicted by solid-line arrows and the flowing direction of the heat medium is depicted by broken-line arrows.

In the heating only operation mode shown in FIG. 4, in the outdoor unit 1, the first refrigerant flow switching device 11 is switched to cause the first heat-source-side refrigerant discharged from the compressor 10*a* to flow into the heat medium relay unit 3 without passing through the heat-source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are completely closed, so that the heat medium circulates between each of the intermediate heat exchangers 15*a* and 15*b* and the use-side heat exchanger 26*a* and between each of the intermediate heat exchangers 15*a* and 15*b* and the use-side heat exchanger 26*b*. Also, the heating only operation mode includes operating the hot-water supplying device 14 and hence heating the second heat medium. In this case, the heating only operation mode is described based on an assumption that the hot-water supplying device 14 is in operation.

First, the flow of the heat-source-side refrigerant in the refrigerant circuit A is described.

The low-temperature low-pressure first heat-source-side refrigerant is compressed by the compressor 10*a*, hence the first heat-source-side refrigerant becomes a high-temperature high-pressure gas refrigerant, and the gas refrigerant is discharged. The high-temperature high-pressure gas refrigerant discharged from the compressor 10*a* passes through the first refrigerant flow switching device 11, flows through the first connection pipe 4*a*, passes through the check valve 13*b*, and flows out from the outdoor unit 1. The high-temperature high-pressure gas refrigerant flowing out from the outdoor unit 1 flows through the refrigerant pipe 4 and flows into the heat medium relay unit 3. One part of the high-temperature high-pressure gas refrigerant flowing into the heat medium relay unit 3 and branched in front of the opening and closing devices 17 passes through the second refrigerant flow switching device 18*a* and the second refrigerant flow switching device 18*b*, and flows into the intermediate heat exchanger 15*a* and the intermediate heat exchanger 15*b*.

The high-temperature high-pressure gas refrigerant flowing into the intermediate heat exchanger 15*a* and the intermediate heat exchanger 15*b* are condensed and liquefied while transferring heat to the heat medium circulating through the heat medium circuit B, and becomes a high-pressure liquid refrigerant. The liquid refrigerant flowing out from the intermediate heat exchanger 15*a* and the intermediate heat exchanger 15*b* is expanded in the expansion device 16*a* and the expansion device 16*b*, and becomes a low-temperature low-pressure two-phase refrigerant. The two-phase refrigerant passes through the opening and closing device 17*b*, flows out from the heat medium relay unit 3, passes through the refrigerant pipe 4, and flows again into the outdoor unit 1. The two-phase refrigerant flowing into the outdoor unit 1 flows through the second connection pipe 4*b*, passes through the check valve 13*c*, and flows into the heat-source-side heat exchanger 12 serving as an evaporator.

Then, the two-phase refrigerant flowing into the heat-source-side heat exchanger 12 receives heat from the outdoor air in the heat-source-side heat exchanger 12, and becomes a low-temperature low-pressure gas refrigerant. The low-temperature low-pressure gas refrigerant flowing out from the heat-source-side heat exchanger 12 is sucked again to the compressor 10*a* through the first refrigerant flow switching device 11 and the accumulator 19.

At this time, the opening degree of the expansion device 16*a* is controlled so that subcooling (the degree of subcooling), which is obtained as the difference between a value obtained by converting the pressure detected by the pressure sensor 36 into a saturation temperature and the temperature detected by the third temperature sensor 35*b*, is held constant. Similarly, the opening degree of the expansion device 16*b* is controlled so that subcooling, which is obtained as the difference between a value obtained by converting the pressure detected by the pressure sensor 36 into a saturation temperature and the temperature detected by the third temperature sensor 35*d*, is held constant. Also, the opening and closing device 17*a* is closed, and the opening and closing device 17*b* is open. If the temperature at an intermediate position between the intermediate heat exchangers 15 can be measured, the temperature at the intermediate position may be used instead of the value of the pressure sensor 36, and accordingly, a system can be formed inexpensively.

Also, the other part of the high-temperature high-pressure gas refrigerant flowing into the heat medium relay unit 3, that is, the first heat-source-side refrigerant branched in front of the closed opening and closing device 17*a* of the heat medium relay unit 3 flows out from the heat medium relay unit 3, and flows into the hot-water supplying device 14 through the refrigerant pipe 4. Then, the first heat-source-side refrigerant flowing into the hot-water supplying device 14 transfers the heating energy to the second heat-source-side refrigerant in the heat exchanger for heating 15*c*, is condensed and liquefied, and becomes a liquid refrigerant. The liquid refrigerant flowing out from the heat exchanger for heating 15*c* is expanded by the expansion device 16*c* and becomes a two-phase gas-liquid refrigerant.

The two-phase gas-liquid refrigerant flowing out from the expansion device 16*c* flows out from the hot-water supplying device 14, flows again into the heat medium relay unit 3 through the refrigerant pipe 4, and is joined with the refrigerant flowing out from the expansion device 16*a* and the expansion device 16*b*.

At this time, the opening degree of the expansion device 16*c* is controlled so that subcooling, which is the temperature difference between the detected temperature of the fifth temperature sensor 40 and the saturation temperature converted from the detected pressure of the third pressure sensor 39, is held constant.

The flow of the second heat-source-side refrigerant in the refrigerant circuit A2 is described.

The second heat-source-side refrigerant is compressed by the compressor 10*b*, and is discharged as a high-temperature high-pressure gas refrigerant. The high-temperature high-pressure gas refrigerant discharged from the compressor 10*b* flows into the intermediate heat exchanger 15*d*. Then, the high-temperature high-pressure gas refrigerant is condensed while transferring heat to the second heat medium in the intermediate heat exchanger 15*d*, and becomes a two-phase refrigerant. In the intermediate heat exchanger 15*d*, the second heat-source-side refrigerant transfers heat to the second heat medium, and hence heats the second heat medium.

The two-phase refrigerant flowing out from the intermediate heat exchanger 15*d* flows into the heat exchanger for heating 15*c* through the expansion device 16*d*. The two-phase refrigerant flowing into the heat exchanger for heating 15*c* receives the heating energy transferred from the first heat-source-side refrigerant. The heat received by the second heat-source-side refrigerant from the first heat-source-side refrigerant is consumed as heat for evaporating the second heat-source-side refrigerant in the heat exchanger for heating 15*c*. The gas refrigerant flowing out from the heat exchanger for heating 15*c* is sucked again to the compressor 10*b*.

At this time, the opening degree of the expansion device 16*d* is controlled so that the degree of superheat, which is the temperature difference between the detected temperature of the fourth temperature sensor 38 and the saturation temperature converted from the detected pressure of the second pressure sensor 37, is held constant. Also, the rotation frequency of the compressor 10*b* is controlled so that the detected temperature of the sixth temperature sensor 41 becomes a target temperature.

The flow of the heat medium in the heat medium circuit B is described.

In the heating only operation mode, the heating energy of the first heat-source-side refrigerant is transferred to the first heat medium in both the intermediate heat exchanger 15*a* and the intermediate heat exchanger 15*b*, and hence the heated first heat medium is caused to flow through the heat medium pipes 5 by the pump 21*a* and the pump 21*b*. The first heat medium compressed by the pump 21*a* and the pump 21*b* and flowing out from the pump 21*a* and the pump 21*b* flows into the use-side heat exchanger 26*a* and the use-side heat exchanger 26*b* through the second heat medium flow switching device 23*a* and the second heat medium flow switching device 23*b*. Then, the first heat medium transfers heat to the indoor air in the use-side heat exchanger 26*a* and the use-side heat exchanger 26*b*, and thus heating for the indoor space 7 is executed.

Then, the first heat medium flows out from the use-side heat exchanger 26*a* and the use-side heat exchanger 26*b*, and flows into the heat medium flow control device 25*a* and the heat medium flow control device 25*b*. At this time, the flow rate of the first heat medium is controlled to the flow rate required for accommodating the load required in the indoor space by the action of the heat medium flow control device 25*a* and the heat medium flow control device 25*b*, and then the heat medium flows into the use-side heat exchanger 26*a* and the use-side heat exchanger 26*b*. The first heat medium flowing out from the heat medium flow control device 25*a* and the heat medium flow control device 25*b* passes through the first heat medium flow switching device 22*a* and the first heat medium flow switching device 22*b*, flows into the intermediate heat exchanger 15*a* and the intermediate heat exchanger 15*b*, and is sucked again to the pump 21*a* and the pump 21*b*.

In the heat medium pipes 5 of the use-side heat exchangers 26, the first heat medium flows in a direction in which the heat medium flows from the second heat medium flow switching devices 23 to the first heat medium flow switching devices 22 through the heat medium flow control devices 25. Also, the air conditioning load required for the indoor space 7 can be accommodated by controlling the difference between the temperature detected by the first temperature sensor 31*a* or the temperature detected by the first temperature sensor 31*b* and the temperature detected by the second temperature sensor 34 to be held at a target value. As the outlet temperatures of the intermediate heat exchangers 15, any of the temperatures of the first temperature sensor 31*a* and the first temperature sensor 31*b*, or the average value of these temperatures may be used.

At this time, the first heat medium flow switching devices 22 and the second heat medium flow switching devices 23 have medium opening degrees so that the passages to both the intermediate heat exchanger 15*a* and the intermediate heat exchanger 15*b* are ensured. Also, although the use-side heat exchanger 26*a* should be controlled in accordance with the temperature difference between the temperature at the inlet and the temperature at the outlet of the use-side heat exchanger 26*a*, since the heat medium temperature at the inlet of each use-side heat exchanger 26 is almost the same as the temperature detected by the first temperature sensor 31*b*, the number of temperature sensors can be decreased if the first temperature sensor 31*b* is used, and hence the system can be formed inexpensively.

When the heating only operation mode is executed, the first heat medium is not required to flow to the use-side heat exchanger 26 having no heat load (including thermo-off). The passage may be closed by the corresponding heat medium flow control device 25, so that the heat medium does not flow to the use-side heat exchanger 26.

The flow of the second heat medium in the heat medium circuit B2 is described.

The heating energy of the second heat-source-side refrigerant is transferred to the second heat medium in the intermediate heat exchanger 15*d*, and the heated second heat medium is caused to flow through the heat medium pipe 5*a* by the pump 21*c*. The second heat medium compressed by and flowing out from the pump 21*c* flows into the hot-water storage tank 24. The second heat medium flowing into the hot-water storage tank 24 flows again into the intermediate heat exchanger 15*d*, and then is sucked to the pump 21*c*.

[Cooling Main Operation Mode]

Figure 5:
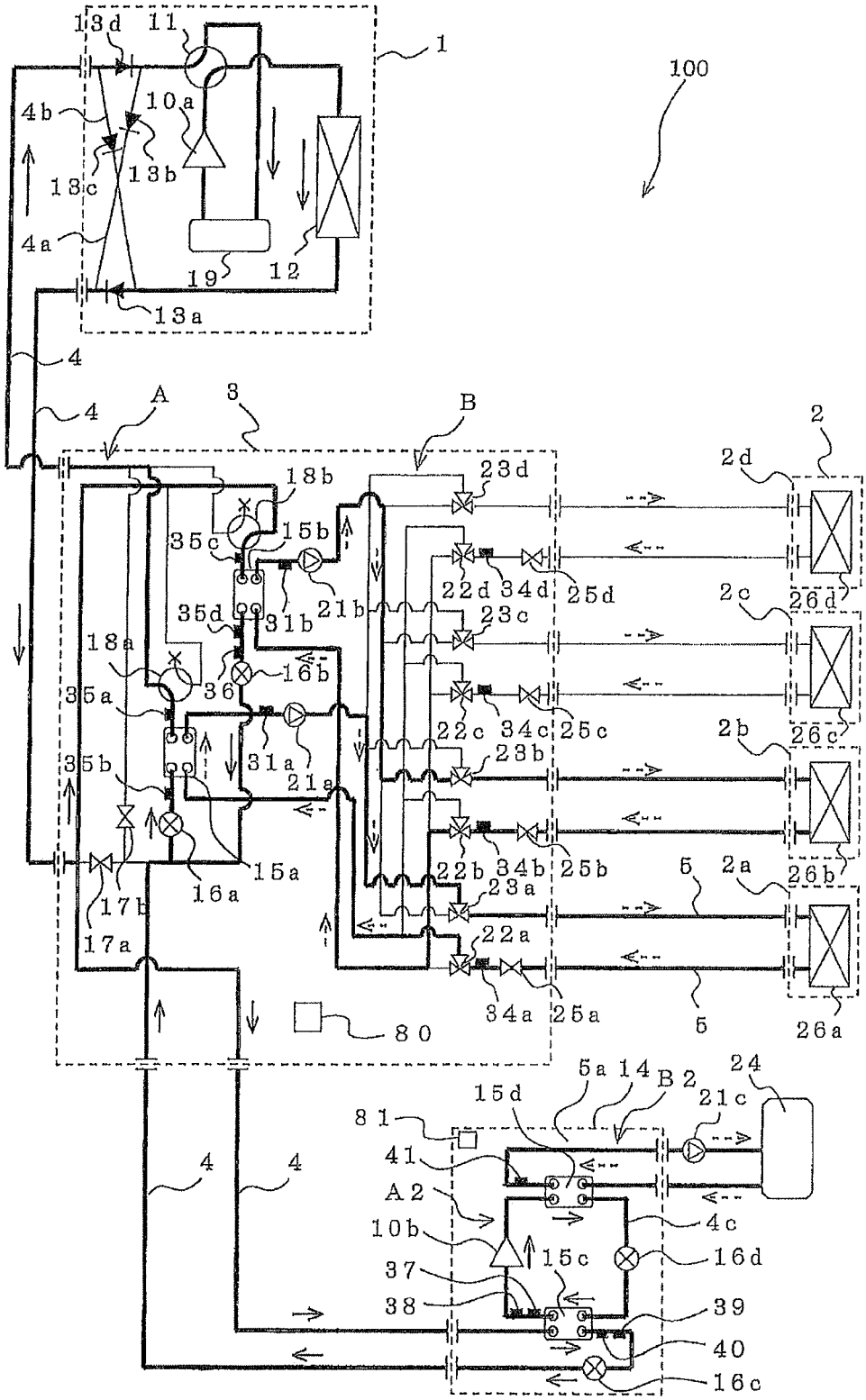
FIG. 5 is a drawing illustrates a flow of the refrigerant and a flow of the heat medium in a cooling main operation of the air-conditioning apparatus shown in FIG. 2.

FIG. 5 is a drawing illustrates the flow of the refrigerant and the flow of the heat medium in a cooling main operation of the air-conditioning apparatus 100 shown in FIG. 2. In FIG. 5, the cooling main operation mode is described with an example in which a cooling load is generated in the use-side heat exchanger 26*a*, and a heating load is generated in the use-side heat exchanger 26*b*. In FIG. 5, pipes depicted by thick lines express pipes through which the refrigerant (the first heat-source-side refrigerant and the second heat-source-side refrigerant) and the heat medium (the first heat medium and the second heat medium) circulate. Also, in FIG. 5, the flowing direction of the refrigerant is depicted by solid-line arrows and the flowing direction of the heat medium is depicted by broken-line arrows.

In the cooling main operation mode shown in FIG. 5, in the outdoor unit 1, the first refrigerant flow switching device 11 is switched to cause the heat-source-side refrigerant discharged from the compressor 10*a* to flow into the heat-source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are completely closed, so that the first heat medium circulates between the intermediate heat exchanger 15*a* and the use-side heat exchanger 26*a*, and between the intermediate heat exchanger 15*b* and the use-side heat exchanger 26*b*. Also, the cooling main operation mode includes operating the hot-water supplying device 14 and hence heating the second heat medium. In this case, the cooling main operation mode is described based on an assumption that the hot-water supplying device 14 is in operation.

First, the flow of the first heat-source-side refrigerant in the refrigerant circuit A is described.

The low-temperature low-pressure first heat-source-side refrigerant is compressed by the compressor 10*a*, hence the first heat-source-side refrigerant becomes a high-temperature high-pressure gas refrigerant, and the gas refrigerant is discharged. The high-temperature high-pressure gas refrigerant discharged from the compressor 10*a* flows into the heat-source-side heat exchanger 12 through the first refrigerant flow switching device 11. Then, the high-temperature high-pressure gas refrigerant is condensed while transferring heat to the outdoor air in the heat-source-side heat exchanger 12, and hence the gas refrigerant becomes a two-phase refrigerant. The two-phase refrigerant flowing out from the heat-source-side heat exchanger 12 passes through the check valve 13*a*, flows out from the outdoor unit 1, passes through the refrigerant pipe 4, and flows into the heat medium relay unit 3. One part of the two-phase refrigerant flowing into the heat medium relay unit 3 passes through the second refrigerant flow switching device 18*b*, and flows into the intermediate heat exchanger 15*b* serving as a condenser.

The two-phase refrigerant flowing into the intermediate heat exchanger 15*b* is condensed and liquefied while transferring heat to the first heat medium circulating through the heat medium circuit B, and hence becomes a liquid refrigerant. The liquid refrigerant flowing out from the intermediate heat exchanger 15*b* is expanded by the expansion device 16*b*, and hence becomes a low-pressure two-phase refrigerant. The low-pressure two-phase refrigerant flows into the intermediate heat exchanger 15*a* serving as an evaporator through the expansion device 16*a*. The low-pressure two-phase refrigerant flowing into the intermediate heat exchanger 15*a* receives heat from the first heat medium circulating through the heat medium circuit B, and hence becomes a low-pressure gas refrigerant while cooling the first heat medium. The gas refrigerant flows out from the intermediate heat exchanger 15*a*, passes through the second refrigerant flow switching device 18*a*, flows out from the heat medium relay unit 3, passes through the refrigerant pipe 4, and flows again into the outdoor unit 1. The refrigerant flowing into the outdoor unit 1 passes through the check valve 13*d*, the first refrigerant flow switching device 11, and the accumulator 19, and then is sucked again to the compressor 10*a*.

At this time, the opening degree of the expansion device 16*b* is controlled so that superheat, which is obtained as the difference between the temperature detected by the third temperature sensor 35*c* and the temperature detected by the third temperature sensor 35*d*, is held constant. Also, the expansion device 16*a* is fully opened, the opening and closing device 17*a* is closed, and the opening and closing device 17*b* is closed. Alternatively, the opening degree of the expansion device 16*b* may be controlled so that subcooling, which is obtained as the difference between a value obtained by converting the pressure detected by the pressure sensor 36 into a saturation temperature and the temperature detected by the third temperature sensor 35*d*, is held constant. Still alternatively, the expansion device 16*b* may be fully opened, and superheat or subcooling may be controlled by the expansion device 16*a*.

Also, the other part of the two-phase refrigerant flowing into the heat medium relay unit 3, that is, the first heat-source-side refrigerant branched in front of the closed opening and closing device 17*a* of the heat medium relay unit 3 flows out from the heat medium relay unit 3, and flows into the hot-water supplying device 14 through the refrigerant pipe 4. Then, the first heat-source-side refrigerant flowing into the hot-water supplying device 14 transfers the heating energy to the second heat-source-side refrigerant in the heat exchanger for heating 15*c*, is condensed and liquefied, and becomes a liquid refrigerant. The liquid refrigerant flowing out from the heat exchanger for heating 15*c* is expanded by the expansion device 16*c* and becomes a two-phase gas-liquid refrigerant.

The two-phase gas-liquid refrigerant flowing out from the expansion device 16*c* flows out from the hot-water supplying device 14, flows again into the heat medium relay unit 3 through the refrigerant pipe 4, and is joined with the refrigerant flowing out from the expansion device 16*b*.

At this time, the opening degree of the expansion device 16*c* is controlled so that subcooling, which is the temperature difference between the detected temperature of the fifth temperature sensor 40 and the saturation temperature converted from the detected pressure of the third pressure sensor 39, is held constant.

The flow of the second heat-source-side refrigerant in the refrigerant circuit A2 is described.

The second heat-source-side refrigerant is compressed by the compressor 10*b*, and discharged as a high-temperature high-pressure gas refrigerant. The high-temperature high-pressure gas refrigerant discharged from the compressor 10*b* flows into the intermediate heat exchanger 15*d*. Then, the gas refrigerant is condensed while transferring heat to the second heat medium in the intermediate heat exchanger 15*d*, and becomes a two-phase refrigerant. In the intermediate heat exchanger 15*d*, the second heat-source-side refrigerant transfers heat to the second heat medium, and hence heats the second heat medium.

The two-phase refrigerant flowing out from the intermediate heat exchanger 15*d* flows into the heat exchanger for heating 15*c* through the expansion device 16*d*, and receives the heating energy transferred from the first heat-source-side refrigerant. The heat received by the second heat-source-side refrigerant from the first heat-source-side refrigerant is consumed as heat for evaporating the second heat-source-side refrigerant in the heat exchanger for heating 15*c*. The gas refrigerant flowing out from the heat exchanger for heating 15*c* is sucked again to the compressor 10*b*.

At this time, the opening degree of the expansion device 16*d* is controlled so that the degree of superheat, which is the temperature difference between the detected temperature of the fourth temperature sensor 38 and the saturation temperature converted from the detected pressure of the second pressure sensor 37, is held constant. Also, the rotation frequency of the compressor 10*b* is controlled so that the detected temperature of the sixth temperature sensor 41 becomes a target temperature.

The flow of the first heat medium in the heat medium circuit B is described.

In the cooling main operation mode, the heating energy of the first heat-source-side refrigerant is transferred to the first heat medium in the intermediate heat exchanger 15*b*, and the heated first heat medium is caused to flow through the heat medium pipe 5 by the pump 21*b*. In the cooling main operation mode, the cooling energy of the heat-source-side refrigerant is transferred to the first heat medium in the intermediate heat exchanger 15*a*, and the cooled first heat medium is caused to flow through the heat medium pipe 5 by the pump 21*a*. The first heat medium compressed by the pump 21*a* and the pump 21*b* and flowing out from the pump 21*a* and the pump 21*b* flows into the use-side heat exchanger 26*a* and the use-side heat exchanger 26*b* through the second heat medium flow switching device 23*a* and the second heat medium flow switching device 23*b*.

The use-side heat exchanger 26*b* executes heating for the indoor space 7 such that the first heat medium transfers heat to the indoor air. Also, the use-side heat exchanger 26*a* executes cooling for the indoor space 7 such that the first heat medium receives heat from the indoor air. At this time, the flow rate of the first heat medium is controlled to the flow rate required for accommodating the load required in the indoor space by the action of the heat medium flow control device 25*a* and the heat medium flow control device 25*b*, and then the heat medium flows into the use-side heat exchanger 26*a* and the use-side heat exchanger 26*b*. The first heat medium, which has passed through the use-side heat exchanger 26*b* and the temperature of which has been slightly decreased, passes through the heat medium flow control device 25*b* and the first heat medium flow switching device 22*b*, flows into the intermediate heat exchanger 15*b*, and is sucked again to the pump 21*b*. The first heat medium, which has passed through the use-side heat exchanger 26*a* and the temperature of which has been slightly increased, passes through the heat medium flow control device 25*a* and the first heat medium flow switching device 22*a*, flows into the intermediate heat exchanger 15*a*, and is sucked again to the pump 21*a*.

In the heat medium pipes 5 of the use-side heat exchangers 26, the first heat medium flows in a direction in which the heat medium flows from the second heat medium flow switching devices 23 to the first heat medium flow switching devices 22 through the heat medium flow control devices 25, at either of the heating side and the cooling side. Also, the air conditioning load required for the indoor space 7 can be accommodated by controlling the difference between the temperature detected by the first temperature sensor 31*b* and the temperature detected by the second temperature sensor 34 at the heating side, or the difference between the temperature detected by the second temperature sensor 34 and the temperature detected by the first temperature sensor 31*a* at the cooling side is held at a target value.

When the cooling main operation mode is executed, the first heat medium is not required to flow to the use-side heat exchanger 26 having no heat load (including thermo-off). The passage may be closed by the corresponding heat medium flow control device 25, so that the first heat medium does not flow to the use-side heat exchanger 26.

The flow of the second heat medium in the heat medium circuit B2 is described.

The heating energy of the second heat-source-side refrigerant is transferred to the second heat medium in the intermediate heat exchanger 15*d*, and the heated second heat medium is caused to flow through the heat medium pipe 5*a* by the pump 21*c*. The second heat medium compressed by and flowing out from the pump 21*c* flows into the hot-water storage tank 24. The second heat medium flowing into the hot-water storage tank 24 flows again into the intermediate heat exchanger 15*d*, and then is sucked to the pump 21*c*.

[Heating Main Operation Mode]

Figure 6:
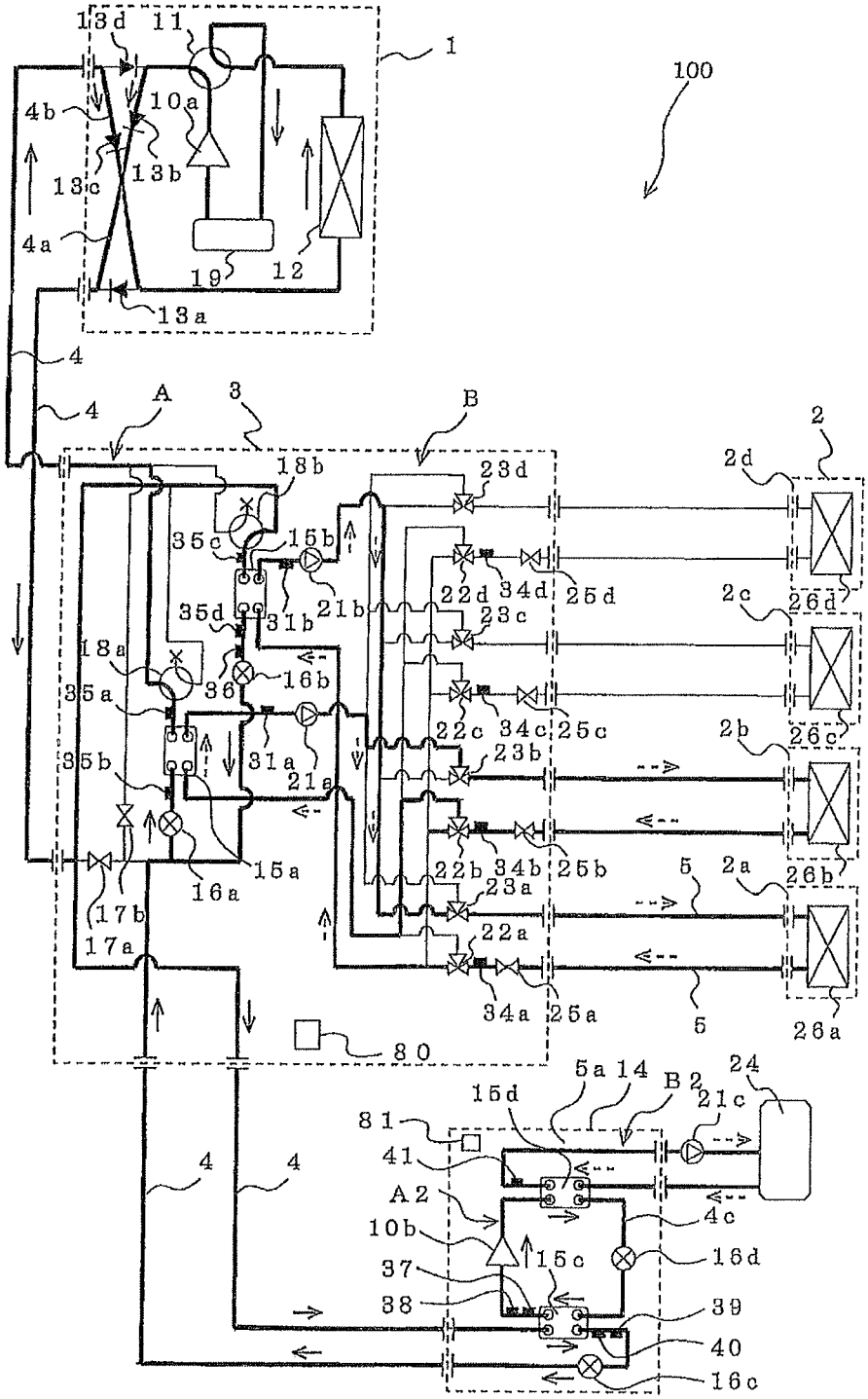
FIG. 6 is a drawing illustrates a flow of the refrigerant and a flow of the heat medium in a heating main operation of the air-conditioning apparatus shown in FIG. 2.

FIG. 6 is a drawing illustrates the flow of the refrigerant and the flow of the heat medium in a heating main operation of the air-conditioning apparatus 100 shown in FIG. 2. In FIG. 6, the heating main operation mode is described with an example in which heating loads are generated only in the use-side heat exchanger 26*a* and the use-side heat exchanger 26*b*. In FIG. 6, pipes depicted by thick lines express pipes through which the refrigerant (the first heat-source-side refrigerant and the second heat-source-side refrigerant) and the heat medium (the first heat medium and the second heat medium) flow. Also, in FIG. 6, the flowing direction of the refrigerant is depicted by solid-line arrows and the flowing direction of the heat medium is depicted by broken-line arrows.

In the heating main operation mode shown in FIG. 6, in the outdoor unit 1, the first refrigerant flow switching device 11 is switched to cause the first heat-source-side refrigerant discharged from the compressor 10*a* to flow into the heat medium relay unit 3 without passing through the heat-source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are completely closed, so that the heat medium circulates between the intermediate heat exchanger 15*a* and the use-side heat exchanger 26*b* and between the intermediate heat exchanger 15*b* and the use-side heat exchanger 26*a*. Also, the heating main operation mode includes operating the hot-water supplying device 14 and hence heating the second heat medium. In this case, the heating main operation mode is described based on an assumption that the hot-water supplying device 14 is in operation.

First, the flow of the heat-source-side refrigerant in the refrigerant circuit A is described.

The low-temperature low-pressure first heat-source-side refrigerant is compressed by the compressor 10*a*, hence the first heat-source-side refrigerant becomes a high-temperature high-pressure gas refrigerant, and the gas refrigerant is discharged. The high-temperature high-pressure gas refrigerant discharged from the compressor 10*a* passes through the first refrigerant flow switching device 11, flows through the first connection pipe 4*a*, passes through the check valve 13*b*, and flows out from the outdoor unit 1. The high-temperature high-pressure gas refrigerant flowing out from the outdoor unit 1 flows through the refrigerant pipe 4 and then flows into the heat medium relay unit 3. One part of the high-temperature high-pressure gas refrigerant flowing into the heat medium relay unit 3 and branched in front of the opening and closing devices 17 passes through the second refrigerant flow switching device 18*b* and flows into the intermediate heat exchanger 15*b* serving as a condenser.

The gas refrigerant flowing into the intermediate heat exchanger 15*b* is condensed and liquefied while transferring heat to the first heat medium circulating through the heat medium circuit B, and becomes a liquid refrigerant. The liquid refrigerant flowing out from the intermediate heat exchanger 15*b* is expanded by the expansion device 16*b*, and becomes a low-pressure two-phase refrigerant. The low-pressure two-phase refrigerant flows into the intermediate heat exchanger 15*a* serving as an evaporator through the expansion device 16*a*. The low-pressure two-phase refrigerant flowing into the intermediate heat exchanger 15*a* receives heat from the first heat medium circulating through the heat medium circuit B, hence evaporates, and cools the first heat medium. The low-pressure two-phase refrigerant flows out from the intermediate heat exchanger 15*a*, passes through the second refrigerant flow switching device 18*a*, flows out from the heat medium relay unit 3, passes through the refrigerant pipe 4, and flows again into the outdoor unit 1.

The two-phase refrigerant flowing into the outdoor unit 1 passes through the check valve 13*c* and flows into the heat-source-side heat exchanger 12 serving as an evaporator. Then, the two-phase refrigerant flowing into the heat-source-side heat exchanger 12 receives heat from the outdoor air in the heat-source-side heat exchanger 12, and becomes a low-temperature low-pressure gas refrigerant. The low-temperature low-pressure gas refrigerant flowing out from the heat-source-side heat exchanger 12 is sucked again to the compressor 10*a* through the first refrigerant flow switching device 11 and the accumulator 19.

At this time, the opening degree of the expansion device 16*b* is controlled so that subcooling, which is obtained as the difference between a value obtained by converting the pressure detected by the pressure sensor 36 into a saturation temperature and the temperature detected by the third temperature sensor 35*b*, is held constant. Also, the expansion device 16*a* is fully opened, and the opening and closing devices 17*a* and 17*b* are closed. Alternatively, the expansion device 16*b* may be fully opened, and subcooling may be controlled by the expansion device 16*a*.

Also, the other part of the high-temperature high-pressure gas refrigerant flowing into the heat medium relay unit 3, that is, the first heat-source-side refrigerant branched in front of the closed opening and closing device 17*a* of the heat medium relay unit 3 flows out from the heat medium relay unit 3, and flows into the hot-water supplying device 14 through the refrigerant pipe 4. Then, the first heat-source-side refrigerant flowing into the hot-water supplying device 14 transfers the heating energy to the second heat-source-side refrigerant in the heat exchanger for heating 15*c*, is condensed and liquefied, and becomes a liquid refrigerant. The liquid refrigerant flowing out from the heat exchanger for heating 15*c* is expanded by the expansion device 16*c* and becomes a two-phase gas-liquid refrigerant.

The two-phase gas-liquid refrigerant flowing out from the expansion device 16*c* flows out from the hot-water supplying device 14, flows again into the heat medium relay unit 3 through the refrigerant pipe 4, and is joined with the refrigerant flowing out from the expansion device 16*b*.

At this time, the opening degree of the expansion device 16*c* is controlled so that subcooling, which is the temperature difference between the detected temperature of the fifth temperature sensor 40 and the saturation temperature converted from the detected pressure of the third pressure sensor 39, is held constant.

The flow of the second heat-source-side refrigerant in the refrigerant circuit A2 is described.

The second heat-source-side refrigerant is compressed by the compressor 10*b*, and is discharged as a high-temperature high-pressure gas refrigerant. The high-temperature high-pressure gas refrigerant discharged from the compressor 10*b* flows into the intermediate heat exchanger 15*d*. Then, the gas refrigerant is condensed while transferring heat to the second heat medium in the intermediate heat exchanger 15*d*, and becomes a two-phase refrigerant. In the intermediate heat exchanger 15*d*, the second heat-source-side refrigerant transfers heat to the second heat medium, and hence heats the second heat medium.

The two-phase refrigerant flowing out from the intermediate heat exchanger 15*d* flows into the heat exchanger for heating 15*c* through the expansion device 16*d*, and receives the heating energy transferred from the first heat-source-side refrigerant. The heat received by the second heat-source-side refrigerant from the first heat-source-side refrigerant is consumed as heat for evaporating the second heat-source-side refrigerant in the heat exchanger for heating 15*c*. The gas refrigerant flowing out from the heat exchanger for heating 15*c* is sucked again to the compressor 10*b*.

At this time, the opening degree of the expansion device 16*d* is controlled so that the degree of superheat, which is the temperature difference between the detected temperature of the fourth temperature sensor 38 and the saturation temperature converted from the detected pressure of the second pressure sensor 37, is held constant. Also, the rotation frequency of the compressor 10*b* is controlled so that the detected temperature of the sixth temperature sensor 41 becomes a target temperature.

The flow of the heat medium in the heat medium circuit B is described.

In the heating main operation mode, the heating energy of the first heat-source-side refrigerant is transferred to the first heat medium in the intermediate heat exchanger 15*b*, and the heated first heat medium is caused to flow through the heat medium pipe 5 by the pump 21*b*. In the heating main operation mode, the cooling energy of the heat-source-side refrigerant is transferred to the first heat medium in the intermediate heat exchanger 15*a*, and the cooled first heat medium is caused to flow through the heat medium pipe 5 by the pump 21*a*. The first heat medium compressed by the pump 21*a* and the pump 21*b* and flowing out from the pump 21*a* and the pump 21*b* flows into the use-side heat exchanger 26*a* and the use-side heat exchanger 26*b* through the second heat medium flow switching device 23*a* and the second heat medium flow switching device 23*b*.

The use-side heat exchanger 26*b* executes cooling for the indoor space 7 such that the first heat medium receives heat from the indoor air. Also, the use-side heat exchanger 26*a* executes heating for the indoor space 7 such that the first heat medium transfers heat to the indoor air. At this time, the flow rate of the first heat medium is controlled to the flow rate required for accommodating the load required in the indoor space by the action of the heat medium flow control device 25*a* and the heat medium flow control device 25*b*, and then the heat medium flows into the use-side heat exchanger 26*a* and the use-side heat exchanger 26*b*. The first heat medium, which has passed through the use-side heat exchanger 26*b* and the temperature of which has been slightly increased, passes through the heat medium flow control device 25*b* and the first heat medium flow switching device 22*b*, flows into the intermediate heat exchanger 15*a*, and is sucked again to the pump 21*a*. The first heat medium, which has passed through the use-side heat exchanger 26*a* and the temperature of which has been slightly decreased, passes through the heat medium flow control device 25*a* and the first heat medium flow switching device 22*a*, flows into the intermediate heat exchanger 15*b*, and is sucked again to the pump 21*b*.

In the heat medium pipes 5 of the use-side heat exchangers 26, the first heat medium flows in a direction in which the heat medium flows from the second heat medium flow switching devices 23 to the first heat medium flow switching devices 22 through the heat medium flow control devices 25, at either of the heating side and the cooling side. Also, the air conditioning load required for the indoor space 7 can be accommodated by controlling the difference between the temperature detected by the first temperature sensor 31*b* and the temperature detected by the second temperature sensor 34 at the heating side, or the difference between the temperature detected by the second temperature sensor 34 and the temperature detected by the first temperature sensor 31*a* at the cooling side is held at a target value.

When the heating main operation mode is executed, the first heat medium is not required to flow to the use-side heat exchanger 26 having no heat load (including thermo-off). The passage may be closed by the corresponding heat medium flow control device 25, so that the first heat medium does not flow to the use-side heat exchanger 26.

The flow of the second heat medium in the heat medium circuit B2 is described.

The heating energy of the second heat-source-side refrigerant is transferred to the second heat medium in the intermediate heat exchanger 15*d*, and the heated second heat medium is caused to flow through the heat medium pipe 5*a* by the pump 21*c*. The second heat medium compressed by and flowing out from the pump 21*c* flows into the hot-water storage tank 24. The second heat medium flowing into the hot-water storage tank 24 flows again into the intermediate heat exchanger 15*d*, and then is sucked to the pump 21*c*.

[Temperature Setting of Hot-water Supplying Device 14]

The hot-water supplying device 14 sets the temperature of the second heat medium at a temperature higher than a target temperature of the first heat medium flowing through the use-side heat exchangers 26*a* to 26*d*. This is because the second heat medium is mainly used for accommodating a hot-water supplying load. For example, a target temperature of the first heat medium flowing through the use-side heat exchangers 26*a* to 26*d* is set at a value of 50 degrees C., and a target temperature of the second heat medium flowing through the intermediate heat exchanger 15*d* is set at a value of 70 degrees C.

Hence, a condensing temperature or a pseudo-condensing temperature of the second heat-source-side refrigerant used in the hot-water supplying device 14 is controlled at a value higher than a condensing temperature or a pseudo-condensing temperature of the refrigerant circulating between the outdoor unit 1 and the heat medium relay unit 3. For example, the condensing temperature or the pseudo-condensing temperature of the second heat-source-side refrigerant used in the hot-water supplying device 14 is controlled at a value of 75 degrees C., and the condensing temperature or the pseudo-condensing temperature of the refrigerant circulating between the outdoor unit 1 and the heat medium relay unit 3 is controlled at a value of 55 degrees C.

[Zeotropic Refrigerant]

In the refrigerant pipe 4 in the first refrigeration cycle, for example, a refrigerant mixture including a refrigerant containing tetrafluoropropene expressed by the chemical formula of $C_3H_2F_4$ (for example, HFO1234yf, HFO1234ze (E)) and a refrigerant containing difluoromethane expressed by the chemical formula of $CH_2F_2$ (R32) circulates. For HFO1234ze, two geometrical isomers are present. One is trans type in which F and $CF_3$ are arranged at symmetric positions with respect to a double bond, and the other is cis type in which F and $CF_3$ are arranged at the same side. Both have different properties. HFO1234ze (E) in Embodiment 1 is trans type.

Since tetrafluoropropene has a double bond in the chemical formula, it may be easily decomposed in the air, has a global warming potential (GWP), which is as low as about 4 (in case of HFO1234yf), and hence is a refrigerant being good for the environment. However, tetrafluoropropene has a smaller density than the density of a refrigerant of R410A or the like, which has been employed for an air-conditioning apparatus of related art. If tetrafluoropropene is solely used as a refrigerant, a compressor has to be very large to provide a large heating capacity and a large cooling capacity. Also, to prevent a pressure loss from being increased in a pipe, the refrigerant pipe has to have a large diameter. This may cause an increase in cost of the air-conditioning apparatus.

Therefore, employment of a refrigerant in which R32 is mixed to tetrafluoropropene is considered. R32 is a refrigerant that is relatively easily used because the refrigerant has a property close to that of a refrigerant of related art. However, R32 has a relatively high GWP, which is as high as about 675, although the GWP of R32 is still lower than the GWP of R410A, which is about 2088. That is, in view of the environmental load, R32 is not so suitable when R32 is solely used without being mixed to other refrigerant.

Hence, by using the refrigerant in which tetrafluoropropene is mixed to R32, an air-conditioning apparatus having an improved property of the refrigerant, being global environment-friendly, and being efficient can be obtained without an excessive increase in GWP. The mixing ratio of tetrafluoropropene and R32 may be, for example, a ratio of 70%:30% by weight %. However, the mixing ratio is not limited thereto.

However, since the boiling point of HFO1234yf is −29 (degrees C.) and the boiling point of R32 is −53.2 (degrees C.), the refrigerant in which tetrafluoropropene is mixed with R32 becomes a zeotropic refrigerant including refrigerants with different boiling points. For example, if the zeotropic refrigerant flows into a liquid pool such as the accumulator 19, the component with the lower boiling point stays as a liquid refrigerant. Accordingly, the circulation composition of the refrigerant circulating through the pipe of the air-conditioning apparatus may change incessantly.

[Temperature Glide in ph Line Diagram of Zeotropic Refrigerant]

Figure 7:
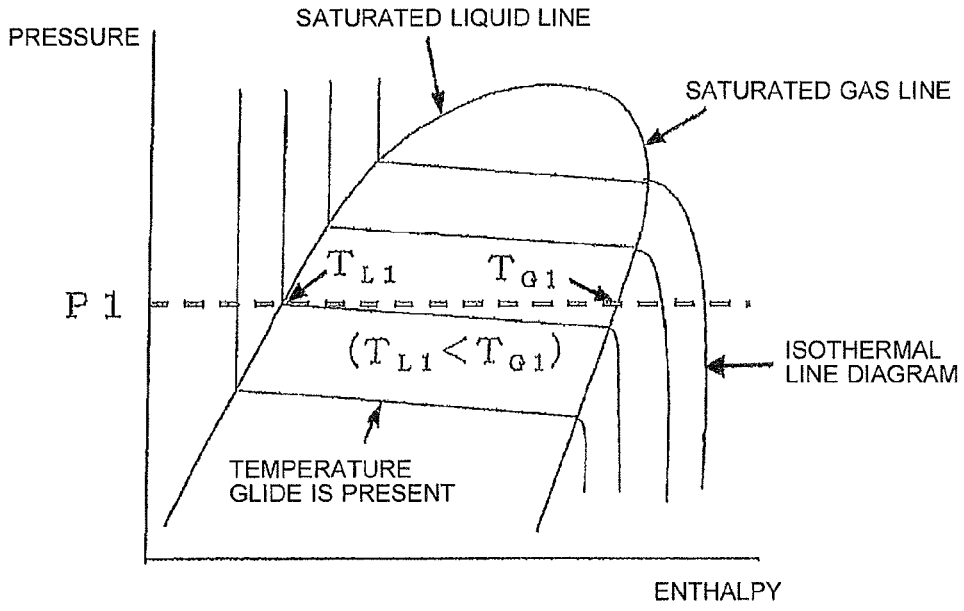
FIG. 7 is an explanatory view for a ph line diagram of a predetermined zeotropic refrigerant.
Figure 8:
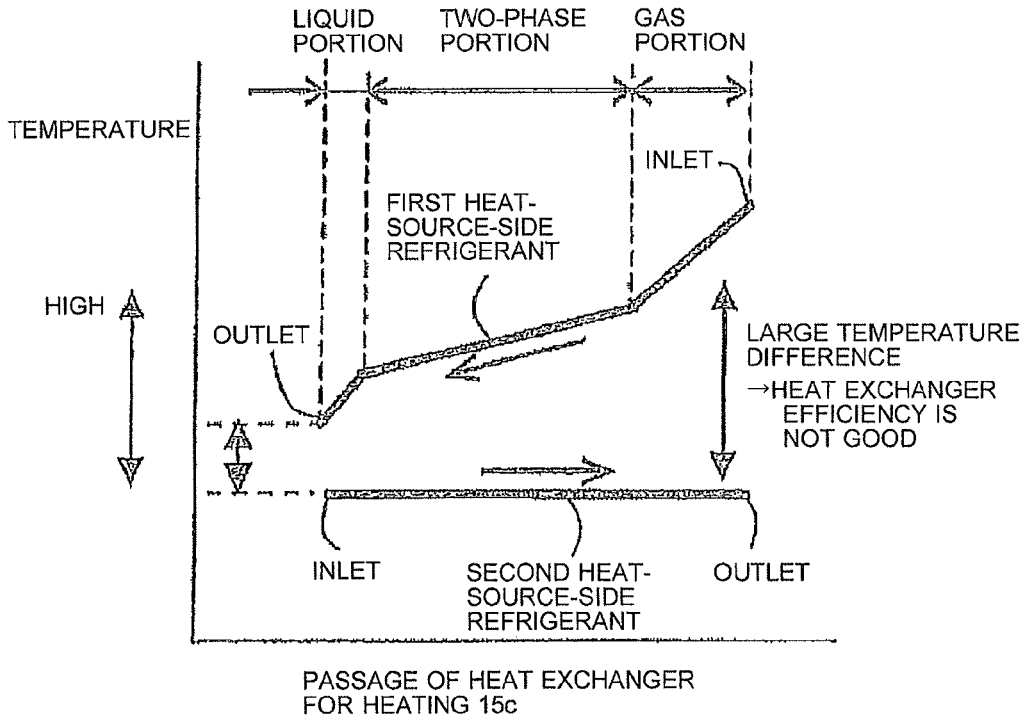
FIG. 8 is an explanatory view for a case in which a zeotropic refrigerant is employed as a first heat-source-side refrigerant and a single refrigerant is employed as a second heat-source-side refrigerant, the view showing refrigerant temperatures of both refrigerants in a heat exchanger for heating.
Figure 9:
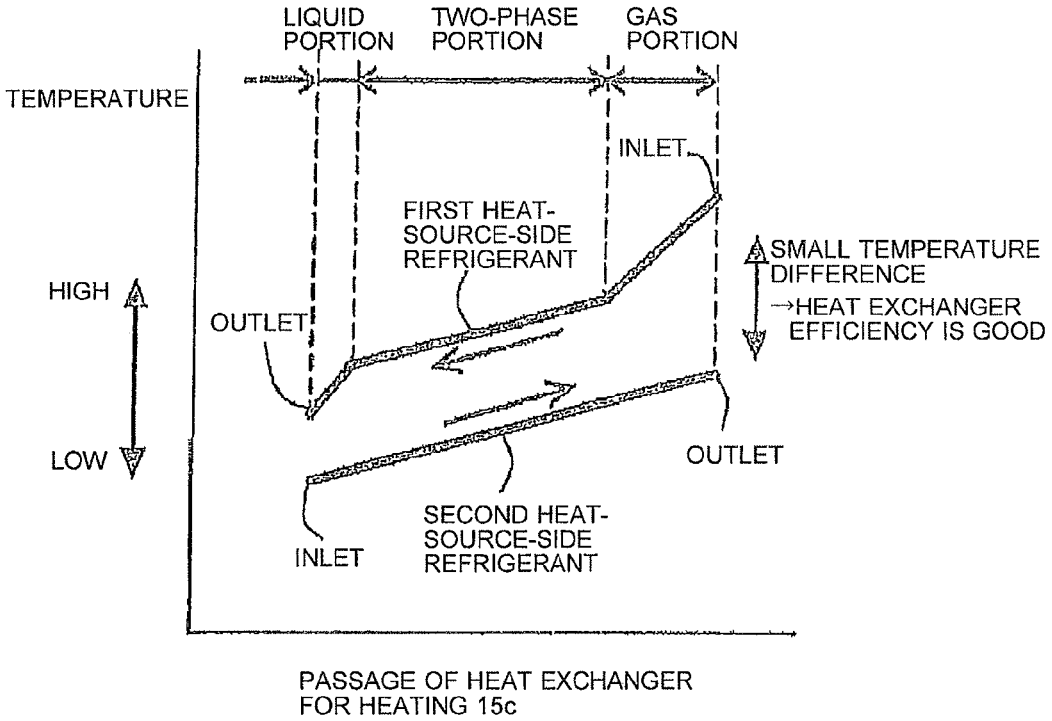
FIG. 9 is an explanatory view for a case in which zeotropic refrigerants are employed as the first heat-source-side refrigerant and the second heat-source-side refrigerant, the view showing refrigerant temperatures of both refrigerants in the heat exchanger for heating.

FIG. 7 is an explanatory view for a ph line diagram (pressure-enthalpy line diagram) of a predetermined zeotropic refrigerant. FIG. 8 is an explanatory view for a case in which a zeotropic refrigerant is employed as the first heat-source-side refrigerant and a single refrigerant is employed as the second heat-source-side refrigerant, the view showing refrigerant temperatures of both refrigerants in the heat exchanger for heating 15*c*. FIG. 9 is an explanatory view for a case in which zeotropic refrigerants are employed as the first heat-source-side refrigerant and the second heat-source-side refrigerant, the view showing refrigerant temperatures of both refrigerants in the heat exchanger for heating 15*c*.

The horizontal axes in FIGS. 8 and 9 each correspond to the passage of the first heat-source-side refrigerant and the passage of the second heat-source-side refrigerant of the heat exchanger for heating 15*c*. That is, the positive direction of the horizontal axis corresponds to the inlet side of the passage of the first heat-source-side refrigerant, and the negative direction corresponds to the outlet side of the passage of the first heat-source-side refrigerant. Also, the positive direction of the horizontal axis corresponds to the outlet side of the passage of the second heat-source-side refrigerant, and the negative direction corresponds to the inlet side of the passage of the second heat-source-side refrigerant. The vertical axes in FIGS. 8 and 9 each represent the temperature of the first heat-source-side refrigerant and the temperature of the second heat-source-side refrigerant. Also, in the following description, it is assumed that "the first heat-source-side refrigerant at the inlet side" represents the first heat-source-side refrigerant flowing into the heat exchanger for heating 15*c*, and "the first heat-source-side refrigerant at the outlet side" represents the first heat-source-side refrigerant flowing out from the heat exchanger for heating 15*c*. This may be similarly applied to the second heat-source-side refrigerant.

As shown in FIG. 7, since the zeotropic refrigerant has different boiling points, a saturated liquid temperature and a saturated gas temperature differ from each other under the same pressure when a ph line diagram is depicted. That is, a saturated liquid temperature $T_{L1}$ with a pressure P1 is lower than a saturated gas temperature $T_{G1}$ with the pressure P1. Accordingly, an isothermal line in a two-phase region of the ph line diagram is inclined at a predetermined temperature glide.

If the ratio of the mixed refrigerants is changed, the ph line diagram is also changed, and the temperature glide is changed. For example, if the mixing ratio of HFO1234yf and R32 is 70%:30%, the temperature glide is 5.6 degrees C. at the high-pressure side, and is about 6.8 degrees C. at the low-pressure side. Also, if the mixing ratio of HFO1234yf and R32 is 50%:50%, the temperature glide is 2.5 degrees C. at the high-pressure side, and is about 2.8 degrees C. at the low-pressure side.

That is, if it is assumed that the pressure loss is small, when the first heat-source-side refrigerant with the above-described mixing ratio is supplied to the heat exchanger for heating 15*c* of the hot-water supplying device 14, the refrigerant temperature is gradually decreased from the inlet to the outlet of the heat exchanger for heating 15*c*.

In case of a refrigerant other than a zeotropic refrigerant mixture, that is, a single refrigerant or a near-azeotropic refrigerant mixture, the circulation composition of the refrigerant is not changed, a change in enthalpy in a region with a two-phase change is used for a phase change of the refrigerant, and hence a temperature glide is not generated. That is, in case of the refrigerant that is not the zeotropic refrigerant, the refrigerant temperature is not gradually decreased from the inlet to the outlet of the heat exchanger for heating 15*c*.

[Advantage 1 by Zeotropic Refrigerant Mixture]

In the heat exchanger for heating 15*c*, the first heat-source-side refrigerant and the second heat-source-side refrigerant form counterflow. That is, regarding the positional relationship between the refrigerants, the first heat-source-side refrigerant at the inlet side corresponds to the second heat-source-side refrigerant at the outlet side, and the first heat-source-side refrigerant at the outlet side corresponds to the second heat-source-side refrigerant at the inlet side.

Now, it is assumed that a single refrigerant or a near-azeotropic refrigerant mixture (for example, HFO1234yf) is employed as the second heat-source-side refrigerant. In this case, as described in [Temperature Glide in ph Line Diagram of Zeotropic Refrigerant], since the single refrigerant or the near-azeotropic refrigerant mixture has the saturated gas temperature and the saturated liquid temperature that are the same or are substantially the same (without a temperature glide) under the same pressure, the temperature in the passage of the second heat-source-side refrigerant of the heat exchanger for heating 15*c* is a substantially constant temperature.

To be specific, the first heat-source-side refrigerant temperature at the inlet side and the second heat-source-side refrigerant temperature at the outlet side, and the first heat-source-side refrigerant temperature at the outlet side and the second heat-source-side refrigerant temperature at the inlet side become temperatures as shown in FIG. 8. In this case, "a subtraction value," which is obtained by subtracting the temperature difference between the saturated gas temperature at the outlet side and the temperature at the inlet side of the second heat-source-side refrigerant in the heat exchanger for heating 15*c* from the temperature difference between the saturated gas temperature at the inlet side and the saturated liquid temperature at the outlet side of the first heat-source-side refrigerant in the heat exchanger for heating 15*c*, is large. As described above, if the single refrigerant or the near-azeotropic refrigerant mixture is employed as the second heat-source-side refrigerant, the above-described "subtraction value" is increased, the heat exchanging efficiency of the heat exchanger for heating 15*c* is decreased, and the operating efficiency of the hot-water supplying device 14 is decreased.

Owing to this, the air-conditioning apparatus 100 according to Embodiment 1 employs a zeotropic refrigerant mixture (for example, a refrigerant mixture of HFO1234yf and R32) as the second heat-source-side refrigerant. In the zeotropic refrigerant mixture, the saturated gas temperature is higher than the saturated liquid temperature under the same pressure (having a temperature glide). Hence, the second heat-source-side refrigerant temperature at the outlet side is higher than the second heat-source-side refrigerant temperature at the inlet side in the heat exchanger for heating 15*c*.

To be specific, the first heat-source-side refrigerant temperature at the inlet side and the second heat-source-side refrigerant temperature at the outlet side, and the first heat-source-side refrigerant temperature at the outlet side and the second heat-source-side refrigerant temperature at the inlet side become temperatures as shown in FIG. 9.

In this case, "a subtraction value," which is obtained by subtracting the temperature difference between the saturated gas temperature at the outlet side and the temperature at the inlet side of the second heat-source-side refrigerant in the heat exchanger for heating 15*c* from the temperature difference between the saturated gas temperature at the inlet side and the saturated liquid temperature at the outlet side of the first heat-source-side refrigerant in the heat exchanger for heating 15*c*, is smaller than "the subtraction value" in FIG. 8. It is to be noted that "the subtraction value" in FIG. 9 corresponds to the temperature difference in a two-phase portion (or the entire region if the degree of superheat is zero in the evaporator) of the first heat-source-side refrigerant and the second heat-source-side refrigerant. As described above, if the zeotropic refrigerant mixture is employed as the second heat-source-side refrigerant, the above-described "subtraction value" is decreased, the heat exchanging efficiency of the heat exchanger for heating 15*c* can be increased, and the operating efficiency of the hot-water supplying device 14 can be increased.

However, since the two-phase refrigerant in the gas-liquid mixed state having a quality in a range from about 0.1 to 0.2 flows into the second heat-source-side refrigerant at the inlet side in the heat exchanger for heating 15*c*, the temperature difference between the outlet side temperature of the second heat-source-side refrigerant and the inlet side temperature of the second heat-source-side refrigerant in the heat exchanger for heating 15*c* is smaller than the temperature difference between the saturated gas temperature and the saturated liquid temperature.

[Advantage 2 by Zeotropic Refrigerant Mixture]

Next, the state of the first heat-source-side refrigerant and the state of the second heat-source-side refrigerant in the heat exchanger for heating 15*c* are described.

The first heat-source-side refrigerant becomes a gas portion (a gas phase) at the inlet side of the heat exchanger for heating 15*c*, becomes a liquid portion (a liquid phase) at the outlet side of the heat exchanger for heating 15*c*, and becomes a two-phase portion (a two gas-liquid phase) between the inlet side and the outlet side. The length of the gas portion and the length of the liquid portion are not so long (as compared with the length of the two-phase portion), and heat transferring efficiencies are small. Hence, the gas portion and the liquid portion have a small contribution with respect to the entire heat exchange amount. Therefore, major part of heat exchange of the heat exchanger for heating 15*c* is performed in the two-phase portion of the first heat-source-side refrigerant.

Also, in the passage of the second heat-source-side refrigerant of the heat exchanger for heating 15*c*, the degree of superheat at the outlet side of the second heat-source-side refrigerant is controlled at a small value. Since the value of the degree of superheat is small and the heat transferring efficiency of the gas phase is small, the major part of heat exchange of the heat exchanger for heating 15*c* is performed in the two-phase portion of the second heat-source-side refrigerant.

Thus, in the heat exchanger for heating 15*c*, heat exchange between the two-phase portion of the first heat-source-side refrigerant and the two-phase portion of the second heat-source-side refrigerant occupy the major part of the total heat exchange amount in the heat exchanger for heating 15*c*.

Therefore, by decreasing the temperature difference between the temperature of the first heat-source-side refrigerant and the second heat-source-side refrigerant in the states of the two-phase portions, the heat exchanging efficiency of the heat exchanger for heating 15*c* can be increased, and the operating efficiency of the hot-water supplying device 14 can be increased. Decreasing the temperature difference in the states of the two-phase portions represents that a temperature difference (a first temperature difference) between "the saturated gas temperature (a point at which the state is changed from gas to two-phase) at the inlet side of the first heat-source-side refrigerant" and "the saturated liquid temperature (a point at which the state is changed from two-phase to liquid) at the outlet side," and a temperature difference (a second temperature difference) between "the saturated gas temperature (a point at which the state is changed from two-phase to gas) at the outlet side of the second heat-source-side refrigerant" and "the temperature at the inlet side (for example, with a quality in a range from 0.1 to 0.2)" in the heat exchanger for heating 15*c* is set at a small value (or causes the first temperature difference and the second temperature difference to be close values).

This state may be provided by adjusting the opening degree of the expansion device 16*d* so that the difference between the first temperature difference and the second temperature difference is held at a predetermined value or less, or by adjusting the opening degree of the expansion device 16*d* so that the second temperature difference becomes close to the first temperature difference. "The predetermined value" is described later.

Also, if the quality of the two-phase refrigerant at the inlet side of the second heat-source-side refrigerant is not so large, for example, in a range from 0.1 to 0.2, the heat exchanging efficiency of the heat exchanger for heating 15*c* can be increased even by setting the first temperature difference and the temperature difference between "the saturated gas temperature (a point at which the state is changed from two-phase to gas) of the second heat-source-side refrigerant" and "the saturated liquid temperature (a point at which the state is changed from two-phase to liquid) of the second heat-source-side refrigerant" are set at values close to each other. Hence, the operating efficiency of the hot-water supplying device 14 can be increased.

[Advantage 3 by Zeotropic Refrigerant Mixture]

Figure 10:
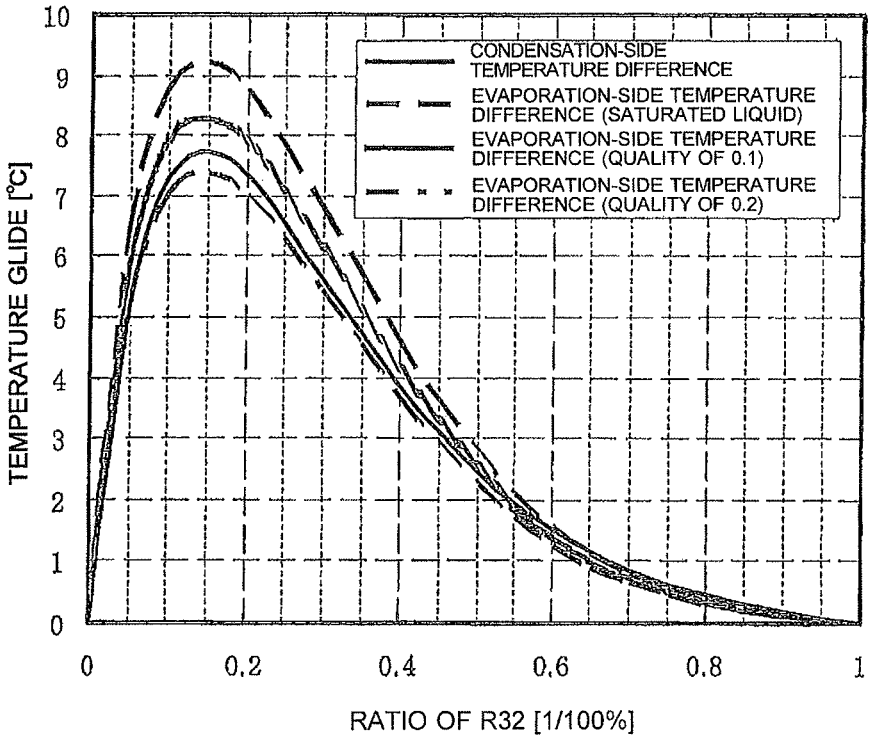
FIG. 10 is an explanatory view of temperature differences between saturated gas and saturated liquid under the same pressure of zeotropic refrigerant mixtures, which are supplied to an intermediate heat exchanger.

FIG. 10 is an explanatory view of the temperature differences between saturated gas and saturated liquid under the same pressure of the zeotropic refrigerant mixture (HFO1234yf and R32), which is supplied to the heat exchanger for heating 15*c* (corresponding to the temperature glide shown in FIG. 7).

In FIG. 10, the horizontal axis plots the ratio of R32 to the refrigerant mixture, and the vertical axis plots the temperature difference of the refrigerant. Also, "the condensation side" corresponds to the side of the heat exchanger for heating 15*c* at which the first heat-source-side refrigerant is condensed, and "the condensation-side temperature difference" represents the temperature difference between saturated gas and saturated liquid under a pressure with which the saturated gas temperature is 45 degrees C., for each mixing ratio.

Also, "the evaporation side" corresponds to the side of the heat exchanger for heating 15*c* at which the second heat-source-side refrigerant is evaporated, and "the evaporation-side temperature difference" represents the temperature difference between the saturated gas and the evaporator-inlet refrigerant under a pressure with which the saturated gas temperature is 5 degrees C., for each mixing ratio.

Further, the evaporation-side temperature difference of the heat exchanger for heating 15*c* is provided with three examples of an inlet quality being "0.1," an inlet quality being "0.2," and "saturated liquid."

As shown in FIG. 10, in the zeotropic refrigerant mixture of HFO1234yf and R32, if the mixing ratios of HFO1234yf and R32 are the same (R32 in FIG. 10 being 0.5), it is found that the temperature difference between the saturated gas and the saturated liquid at the evaporation side is larger than the temperature difference between the saturated gas and the saturated liquid at the condensation side.

Also, even if the quality of the second heat-source-side refrigerant is 0.1, the temperature difference at the evaporation side is larger than the temperature difference at the condensation side. That is, in the heat exchanger for heating 15*c*, if the inlet quality of the second heat-source-side refrigerant at the evaporation side is as small as about 0.1, the temperature difference between the saturated gas and the saturated liquid of the second heat-source-side refrigerant at the evaporation side is larger than the temperature difference between the saturated gas and the saturated liquid of the first heat-source-side refrigerant at the condensation side.

Further, even if the quality of the second heat-source-side refrigerant at the inlet side at the evaporation side is 0.2, the temperature difference at the condensation side is larger than the temperature difference at the evaporation side. That is, in the heat exchanger for heating 15*c*, the temperature difference between the saturated gas and the saturated liquid of the first heat-source-side refrigerant at the condensation side is slightly larger than the temperature difference between the saturated gas and the saturated liquid of the second heat-source-side refrigerant at the evaporation side.

Hence, the ratio of the first heat-source-side refrigerant and the second heat-source-side refrigerant may be set, for example, as follows on the basis of FIG. 10.

That is, if the ratio of R32 to the first heat-source-side refrigerant is 20%, the ratio of R32 to the second heat-source-side refrigerant is set at about 8% or about 24%. This is because, as shown in FIG. 10, if the ratio of R32 to the first heat-source-side refrigerant is 20%, the temperature difference between the saturated gas and the saturated liquid is 7.3 degrees C. Hence, when the quality of the second heat-source-side refrigerant is 0.1, if the ratio of R32 to the second heat-source-side refrigerant is set at about 8% or about 24%, the temperature difference can be set at about 7.3 degrees C.

This situation corresponds to the situation that the temperature difference (the first temperature difference) between "the saturated gas temperature (the point at which the state is changed from gas to two-phase) at the inlet side of the first heat-source-side refrigerant" and "the saturated liquid temperature (the point at which the state is changed from two-phase to liquid) at the outlet side" in the heat exchanger for heating 15*c* and the temperature difference (the second temperature difference) between "the saturated gas temperature (the point at which the state is changed from two-phase to gas) at the outlet side of the second heat-source-side refrigerant" and "the temperature (for example, the quality being in a range from 0.1 to 0.2) at the inlet side" in the heat exchanger for heating 15*c* are set at values close to each other, as described in [Advantage 2 by Zeotropic Refrigerant Mixture]. Accordingly, the heat exchanging efficiency of the heat exchanger for heating 15*c* can be increased, and the operating efficiency of the hot-water supplying device 14 can be increased.

Actually, even if both the temperatures have a temperature difference of 1 degree C. or less, the temperature difference does not markedly affect the heat exchanging efficiency. For example, if the ratio of R32 to the first heat-source-side refrigerant is 20%, and the quality of the second heat-source-side refrigerant is 0.1, the ratio of R32 to the second heat-source-side refrigerant may be preferably set in a range from 6% to 29%. Accordingly, the difference between the first temperature difference and the second temperature difference may be 1 degree C. or less.

Also, if the inlet quality of the second heat-source-side refrigerant is extremely small, the second heat-source-side refrigerant may be assumed as saturated liquid. If the ratio of R32 to the first heat-source-side refrigerant is 20%, by setting the ratio of R32 to the second heat-source-side refrigerant at 6% or 28%, the first temperature difference and the second temperature difference can be values close to each other. By setting the ratio of R32 to the second heat-source-side refrigerant in a range from 5% to 8% or from 23% to 32%, the difference of the second temperature difference with respect to the first temperature difference may fall within 1 degree C. or less.

As described above, by charging the refrigerant to the air-conditioning apparatus 100 so that the difference of the second temperature difference with respect to the first temperature difference is held in 1 degree C. or less, or preferably the temperature differences are values further close to each other, the heat exchanging efficiency of the heat exchanger for heating 15*c* can be increased, and the operating efficiency of the hot-water supplying device 14 can be increased.

[Charging Method of Zeotropic Refrigerant Mixture]

The mixing ratios of R32 and HFO1234yf of the first heat-source-side refrigerant and the second heat-source-side refrigerant have been described. Next, a method of charging the refrigerant with this mixing ratio to the air-conditioning apparatus 100 is described.

A method of charging a refrigerant with a predetermined mixing ratio to the air-conditioning apparatus 100 may be a method of charging a refrigerant by using refrigerant cylinders charged with refrigerants with different composition ratios, as a refrigerant to be charged to the first refrigeration cycle and a refrigerant to be charged to the second refrigeration cycle.

For example, in a multi-air-conditioning apparatus for a building, such as the air-conditioning apparatus 100, the first heat-source-side refrigerant is charged after the devices are installed at the site. To be more specific, after the devices are installed, the first heat-source-side refrigerant is charged to the first refrigeration cycle by using the refrigerant cylinder containing R32 by a ratio of 20%.

In contrast, the second heat-source-side refrigerant is charged to the devices before shipment from a factory. To be more specific, if the inlet quality of the second heat-source-side refrigerant of the second heat-source-side refrigerant passage of the heat exchanger for heating 15*c* is 0.1, the second heat-source-side refrigerant is previously charged to the second refrigeration cycle before shipment from the factory, by using the refrigerant cylinder containing R32 by the ratio of about 8% or about 24% to the second heat-source-side refrigerant.

As described above, it is the simplest to charge the first heat-source-side refrigerant and the second heat-source-side refrigerant to the first refrigeration cycle and the second refrigeration cycle by using the refrigerant cylinders containing R32 by predetermined ratios. However, in reality, it is rare that two types of refrigerants containing R32 by predetermined ratios, that is, by suitable ratios are commercialized and distributed in the market.

For example, if only the refrigerant cylinder containing R32 by the ratio of 20% is distributed as the refrigerant mixture in the marked, the first heat-source-side refrigerant and the second heat-source-side refrigerant may be charged to the air-conditioning apparatus 100 as follows.

For example, if only the refrigerant cylinder containing R32 by the ratio of 20% is distributed as the refrigerant mixture in the marked, the refrigerant is charged as the first heat-source-side refrigerant to the first refrigeration cycle at the site. Here, it is assumed that the refrigerant containing R32 by the ratio of 24% is desired to be charged as the second refrigerant to the second refrigeration cycle.

At this time, HFO1234yf is first charged to the second refrigeration cycle by an amount that is 0.76 times a prescribed refrigerant amount, and then a refrigerant of R32 is charged by an amount 0.24 times the prescribed refrigerant amount in the factory by using a refrigerant cylinder of HFO1234yf and a refrigerant cylinder of R32. Then the apparatus may be shipped.

Also, it may be occasionally difficult to charge two types of refrigerants contained in the second heat-source-side refrigerant in the factory in view of the manufacturing process. In this case, a charge port may be preferably provided to a pipe or the like forming the second refrigeration cycle so that a refrigerant can be additionally charged later on. Accordingly, HFO1234yf may be charged in the factory to the second refrigeration cycle by the amount 0.76 times the prescribed refrigerant amount and the apparatus may be shipped. Then, after the shipment, the refrigerant of R32 may be additionally charged by the amount 0.24 times the prescribed refrigerant amount by the refrigerant cylinder of R32.

As described above, since the air-conditioning apparatus 100 employs the refrigerant charging method of charging the second heat-source-side refrigerant to the second refrigeration cycle so that the plurality of single refrigerants forming the second heat-source-side refrigerant has the predetermined mixing ratio, the difference between the first temperature difference and the second temperature difference can be held in the predetermined value or less, and the heat exchanging efficiency between the first heat-source-side refrigerant and the second heat-source-side refrigerant flowing into the heat exchanger for heating 15 can be increased.

[Refrigerant Pipe 4]

As described above, the air-conditioning apparatus 100 according to Embodiment 1 includes the some operation modes. In any of these operation modes, the heat-source-side refrigerant flows through the pipe 4 that connects the outdoor unit 1 with the heat medium relay unit 3.

[Heat Medium Pipe 5]

In any of the some operation modes that are executed by the air-conditioning apparatus 100 according to Embodiment 1, a heat medium, such as water or an antifreeze, flows through the heat medium pipe 5 that connects the heat medium relay unit 3 with the indoor unit 2.

[Conclusion of Embodiment 1]

With the air-conditioning apparatus 100 according to Embodiment 1, since the air-conditioning apparatus 100 according to Embodiment 1 employs the refrigerant charging method of charging the second heat-source-side refrigerant to the second refrigeration cycle so that the plurality of single refrigerants forming the second heat-source-side refrigerant have the predetermined mixing ratio, the difference between the first temperature difference and the second temperature difference can be held in the predetermined value or less, and the heat exchanging efficiency between the first heat-source-side refrigerant and the second heat-source-side refrigerant flowing into the heat exchanger for heating 15*c* can be increased. Also, since the heat exchanging efficiency can be increased, energy can be saved by the amount of the increase in heat exchanging efficiency.

Embodiment 2

Figure 11:
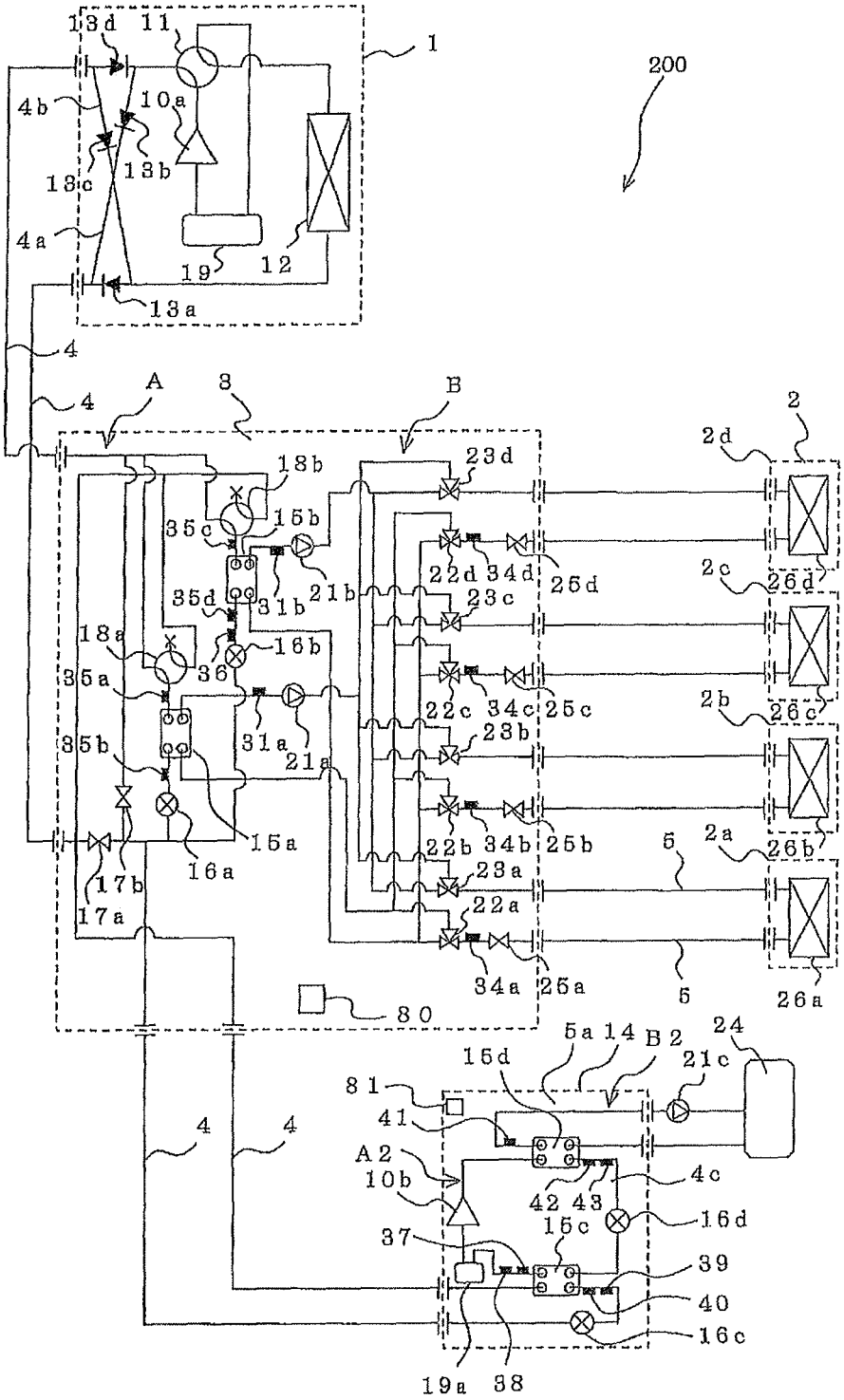
FIG. 11 illustrates a circuit configuration example of an air-conditioning apparatus according to Embodiment 2 of the invention.

FIG. 11 illustrates a circuit configuration example of an air-conditioning apparatus 200 according to Embodiment 2. In Embodiment 2, the same reference signs are used for the same parts as those in Embodiment 1, and points different from Embodiment 1 are mainly described.

For example, in the case of the air-conditioning apparatus 100 according to Embodiment 1, the frequency of the compressor 10*b* of the second refrigeration cycle may be changed in accordance with a change in condensing temperature, a change in refrigerant circulating amount, a target value of the outlet temperature (a hot-water output temperature) of the hot-water supplying device 14 for the second heat medium to be supplied to the hot-water storage tank 24, a change in circulating amount of the second heat medium, and the like, and the inlet quality of the second heat-source-side refrigerant flowing into the heat exchanger for heating 15*c* may be changed.

As described above, if the inlet quality of the second heat-source-side refrigerant is changed, the second heat-source-side refrigerant temperature at the inlet side may be changed. That is, the temperature difference between the second heat-source-side refrigerant temperature at the outlet side and the second heat-source-side refrigerant temperature at the inlet side in the heat exchanger for heating 15*c* may be changed, that is, the second temperature difference in the heat exchanger for heating 15*c* may be changed. Since the second temperature difference is changed, the second temperature difference may be shifted from the temperature difference of the first heat-source-side refrigerant, and the shift may decrease the heat exchanging efficiency in the heat exchanger for heating 15*c*.

The air-conditioning apparatus 200 according to Embodiment 2 can increase the heat exchanging efficiency of the heat exchanger for heating 15*c* and increase the operating efficiency of the hot-water supplying device 14 even if the inlet quality of the second heat-source-side refrigerant is changed.

As shown in FIG. 11, in the air-conditioning apparatus 200, an accumulator 19*a* is arranged between the suction side of the compressor 10*b* and the heat exchanger for heating 15*c* of the second refrigeration cycle. The accumulator 19*a* can change the amount of the second heat-source-side refrigerant to be stored. Accordingly, the circulation composition of the second heat-source-side refrigerant circulating through the second refrigeration cycle can be changed.

Since HFO1234yf has the boiling point of −29 degrees C., and R32 has the boiling point of −53.2 degrees C., R32 evaporates first. Then, with reference to the composition ratio at the time of charging, R32 is more contained in refrigerant gas and HFO1234yf is more contained in refrigerant liquid in the two-phase gas-liquid state. When the second heat-source-side refrigerant in the two-phase gas-liquid state flows into the accumulator 19*a*, the liquid refrigerant is stored. Hence, HFO1234yf having the higher boiling point is stored in the accumulator 19*a* more than R32. That is, with reference to the composition ratio at the time of charging, the circulation composition of the second heat-source-side refrigerant circulating through the second refrigeration cycle indicates that R32 is more contained.

For example, when the ratio of R32 to the first heat-source-side refrigerant in the first refrigeration cycle is 20%, if the second heat-source-side refrigerant of the second refrigeration cycle is charged so that the ratio of R32 is 8%, the second temperature difference, which is the temperature difference between "the saturated-gas-side temperature of the second heat-source-side refrigerant" and "the two-phase refrigerant temperature at the inlet side of the second heat-source-side refrigerant," can be controlled to be large by adjusting the opening degree of the expansion device 16*d* and hence adjusting the refrigerant amount of the refrigerant stored in the accumulator 19*a*.

Also, when the second heat-source-side refrigerant of the second refrigeration cycle is charged so that the ratio of R32 is 24%, the second temperature difference can be controlled to be small by adjusting the opening degree of the expansion device 16*d* and hence adjusting the amount of the refrigerant stored in the accumulator 19*a*.

That is, since the accumulator 19*a* can control the second temperature difference to be large, or control the second temperature difference to be small, even if the quality of the second heat-source-side refrigerant is changed, the difference of the second temperature difference with respect to the first temperature difference can be held in 1 degree C. or less.

In Embodiment 2, by changing the opening degree of the expansion device 16*d* with use of the saturated gas temperature and the saturated liquid temperature calculated from the detected pressure of the second pressure sensor 37 and the detected temperature of the fourth temperature sensor 38, the quality of the second heat-source-side refrigerant flowing into the accumulator 19*a* is controlled, and hence the circulation composition is controlled.

At this time, the quality of the inlet refrigerant of the second heat-source-side refrigerant of the heat exchanger for heating 15*c* may be assumed from the temperature difference between the saturated gas temperature and the saturated liquid temperature of the second heat-source-side refrigerant, and the temperature difference between the temperature of the saturated gas of the heat exchanger for heating 15*c* and the temperature of the inlet refrigerant of the second heat-source-side refrigerant may be presumed.

Also, the circulation composition can be more precisely controlled if the calculation result of the quality of the second heat-source-side refrigerant flowing into the heat exchanger for heating 15*c* is used.

Therefore, as shown in FIG. 11, a fourth pressure sensor 42 that detects the pressure of the second heat-source-side refrigerant flowing out from the intermediate heat exchanger 15*d*, and a seventh temperature sensor 43 that detects the temperature of the second heat-source-side refrigerant flowing out from the intermediate heat exchanger 15*d* may be provided. Based on the detection results of the fourth pressure sensor 42 and the seventh temperature sensor 43, an enthalpy of the second heat-source-side refrigerant flowing out from the intermediate heat exchanger 15*d* is calculated, the quality of the inlet refrigerant of the second heat-source-side refrigerant of the heat exchanger for heating 15*c* is calculated, and the enthalpy and the quality are used for the control of the circulation composition.

In the above description of Embodiment 2, the case has been described, in which the difference between the first temperature difference and the second temperature difference is shifted because of a change in inlet quality of the second heat-source-side refrigerant circulating through the second refrigeration cycle, and the heat exchanging efficiency is decreased in the heat exchanger for heating 15*c*.

There may be also a case in which the heat exchanging efficiency is decreased in the heat exchanger for heating 15*c* because of the first heat-source-side refrigerant circulating through the first refrigeration cycle. This case is described below.

In the first refrigeration cycle, the refrigerant amount required for the refrigeration cycle in a cooling only operation may differ from the refrigerant amount required for the refrigeration cycle in a heating only operation. That is, the cooling only operation requires the refrigerant by a larger amount. Since an excessive refrigerant is generated in a heating only operation, the excessive first heat-source-side refrigerant may be stored in the accumulator 19.

Then, the composition of R32 contained in the circulating first heat-source-side refrigerant is changed in accordance with the stored amount in the accumulator 19. That is, as the result that the first temperature difference, which is the difference between the first heat-source-side refrigerant temperature at the outlet side and the first heat-source-side refrigerant temperature at the inlet side in the heat exchanger for heating 15*c*, is changed, the difference between the first temperature difference and the second temperature difference may be shifted, and the heat exchanging efficiency may be decreased in the heat exchanger for heating 15*c*.

Hence, the stored amount of the second heat-source-side refrigerant of the accumulator 19*a* may be preferably changed by controlling the opening degree of the expansion device 16*d*. Accordingly, the ratio of R32 and HFO1234yf of the second heat-source-side refrigerant circulating through the second refrigeration cycle is changed, the shift in the difference between the first temperature difference and the second temperature difference is decreased, the heat exchanging efficiency of the heat exchanger for heating 15*c* can be increased, and thus the operating efficiency of the hot-water supplying device 14 can be increased.

In any of Embodiments 1 and 2, if only the heating load or the cooling load is generated in the use-side heat exchangers 26, the opening degrees of the corresponding first heat medium flow switching devices 22 and the corresponding second heat medium flow switching devices 23 are set at medium opening degrees, so that the heat medium flows to both the intermediate heat exchanger 15*a* and the intermediate heat exchanger 15*b*. Accordingly, since both the intermediate heat exchanger 15*a* and the intermediate heat exchanger 15*b* can be used for the heating operation or the cooling operation, the heat transferring area is increased, and the efficient heating operation or the efficient cooling operation can be executed.

Also, if the heating load and the cooling load are generated in a mixed manner in the use-side heat exchangers 26, by switching the first heat medium flow switching device 22 and the second heat medium flow switching device 23 corresponding to the use-side heat exchanger 26 that executes the heating operation are switched to the passages connected to the intermediate heat exchanger 15*b* for heating, and by switching the first heat medium flow switching device 22 and the second heat medium flow switching device 23 corresponding to the use-side heat exchanger 26 that executes the cooling operation are switched to the passages connected to the intermediate heat exchanger 15*a* for cooling, the heating operation and the cooling operation can be desirably executed in the respective indoor units 2.

The first heat medium flow switching devices 22 and the second heat medium flow switching devices 23 described in any of Embodiments 1 and 2 may be each, for example, a configuration that can provide switching for a three-way passage such as a three-way valve, or a combination of two configurations that open and close two-way passages such as opening and closing valves, as long as the configuration can provide switching for a passage.

Also, the first heat medium flow switching devices 22 and the second heat medium flow switching devices 23 may be each formed by combining two configurations including a configuration that can change the flow rate of a three-way passage such as a mixing valve driven by a stepping motor, and a configuration that can change the flow rate of a two-way passage such as an electronic expansion valve. In this case, a water hammer caused by sudden opening or closing of a passage can be prevented.

Further, in any of Embodiments 1 and 2, each heat medium flow control device 25 is described as the two-way valve; however, the heat medium flow control device 25 may be a control valve having a three-way passage and may be provided with a bypass pipe that bypasses through the corresponding use-side heat exchanger 26.

Also, each use-side heat medium flow control device 25 may be preferably a configuration that can control the flow rate of a heat medium flowing through a passage while driven by a stepping motor. That is, the use-side heat medium flow control device 25 may be a two-way valve or a three-way valve with an end being closed. Also, a configuration that opens and closes a two-way passage, such as an opening and closing valve may be used as the use-side heat medium flow control device 25, and the flow rate may be controlled to be an average flow rate by repeating ON/OFF.

Each second refrigerant flow switching device 18 is presented as being a four-way valve; however, it is not limited thereto. A plurality of two-way flow switching valves and a plurality of three-way flow switching valves may be used, so that the refrigerant flows similarly.

In any of Embodiments 1 and 2, a configuration can be established similarly even if the use-side heat exchanger 26 and the heat medium flow control device 25 are provided by one each. Further, a plurality of the intermediate heat exchangers 15 and a plurality of the expansion devices 16 that have similar actions may be provided. Further, the example in which the heat medium flow control devices 25 are arranged in the heat medium relay unit 3 has been described; however, it is not limited thereto. The heat medium flow control devices 25 may be arranged in the respective indoor units 2, or may be formed separately from the heat medium relay unit 3 and the indoor units 2.

In the above-described example, the refrigerant mixture of R32 and HFO1234yf has been used as the first heat-source-side refrigerant and the second heat-source-side refrigerant, and the refrigerant mixture with 20%-R32 and 80%-HFO1234yf has been used. Needless to mention, the mixing ratio is not limited thereto, and the refrigerant type is not limited thereto. A zeotropic refrigerant mixture such as R407C (R32:R125:R134a=23%:25%:52%), or other zeotropic refrigerant mixture may be used. Even with such a zeotropic refrigerant mixture, similar advantages can be attained.

The first heat medium and the second heat medium may use the same heat medium or different heat media. The heat medium (the first heat medium and the second heat medium) may be, for example, brine (an antifreeze), water, a liquid mixture of brine and water, a liquid mixture of water and an additive having a high anti-corrosive effect, or other material. Hence, even if the heat medium leaks to the indoor space 7 through any of the indoor units 2, since the heat medium has a high degree of safety, the heat medium makes a contribution to an increase in safety.

Also, in general, the heat-source-side heat exchanger 12 and the use-side heat exchangers 26*a* to 26*d* are provided with air-sending devices, and in many cases, condensation or evaporation is promoted by sending the air. However, it is not limited thereto. For example, configurations like panel heaters using radiation may be used as the use-side heat exchangers 26*a* to 26*d*, a water-cooled configuration in which heat is transferred by using water or an antifreeze may be used as the heat-source-side heat exchanger 12. Any configuration may be used as long as the configuration has a structure that can transfer heat or receive heat.

Also, in this case, the example of the four use-side heat exchangers 26*a* to 26*d* has been described; however, any number of the use-side heat exchangers may be connected.

Also, the example of the two intermediate heat exchangers 15*a* and 15*b* has been described; however, needless to mention, it is not limited thereto. Any number of the intermediate heat exchangers may be arranged as long as the intermediate heat exchangers can cool or/and heat the heat medium.

Also, the pump 21*a* and the pump 21*b* do not have to be provided by one each, and a plurality of small-capacity pumps may be arranged in parallel.

Also, if the first refrigeration cycle or/and the second refrigeration cycle each have a function that can detect the circulation composition, the first refrigeration cycle or/and the second refrigeration cycle can be controlled further precisely. The circulation compositions may be detected by measuring the pressures and temperatures at the inlets and outlets of the expansion devices 16*a*, 16*b*, 16*c*, and 16*d* and calculating the circulation compositions. The circulation composition of the refrigerant may be detected by other method. Also, the circulation composition of the refrigerant in a state in which the refrigerant is not stored in the accumulator 19 or/and 19*a* may be a charge composition of the refrigerant at the time of installation. The amount of refrigerant stored in the accumulator may be expected based on an operating state (measurement values of temperatures and pressures of respective units), and the circulation composition may be calculated on the basis of the expected value.

Also, in any of Embodiments 1 and 2, the following configuration examples have been described. That is, the compressor 10, the four-way valve (the first refrigerant flow switching device) 11, and the heat-source-side heat exchanger 12 are housed in the outdoor unit 1. Also, the use-side heat exchangers 26 are housed in the respective indoor units 2, and the intermediate heat exchangers 15 and the expansion devices 16 are housed in the heat medium relay unit 3. Further, the example of the system has been described, in which the outdoor unit 1 and the heat medium relay unit 3 are connected through the pair of two pipes, the first heat-source-side refrigerant circulates between the outdoor unit 1 and the heat medium relay unit 3, each of the indoor units 2 and the heat medium relay unit 3 are connected through the pair of two pipes, the first heat medium circulates between the indoor units 2 and the heat medium relay unit 3, and the intermediate heat exchangers 15 exchange heat between the first heat-source-side refrigerant and the first heat medium. However, the air-conditioning apparatus 100, 200 is not limited thereto.

For example, the air-conditioning apparatus may be applied to a direct expansion system, in which the compressor 10, the four-way valve (the first refrigerant flow switching device) 11, and the heat-source-side heat exchanger 12 are housed in the outdoor unit 1, a load-side heat exchanger that exchanges heat between the air in an air-conditioned space and the first heat-source-side refrigerant, and the expansion device 16 are housed in each indoor unit 2, a relay unit is provided separately from the outdoor unit 1 and the indoor unit 2, the outdoor unit 1 and the relay unit are connected through a pair of two pipes, the indoor unit 2 and the relay unit are connected through a pair of two pipes, the first heat-source-side refrigerant circulates between the outdoor unit 1 and the indoor unit 2 through the relay unit, and thus the cooling only operation, the heating only operation, the cooling main operation, and the heating main operation can be executed. With this system, similar advantages are attained.

Also, the description has been provided in which cooling and heating mixed operation can be executed. However, it is not limited thereto. The intermediate heat exchanger 15 and the expansion device 16 may be provided by one each, the plurality of use-side heat exchangers 26 and the plurality of heat medium flow control devices 25 may be connected in parallel to the intermediate heat exchanger 15 and the expansion device 16, and only the cooling operation or the heating operation may be executed. Even with this configuration, similar advantages are attained. Also, the configuration may be a direct expansion system that circulates a refrigerant to an indoor unit, and may execute only the cooling operation or the heating operation.

The invention claimed is:

1. A refrigerant charging method for an air-conditioning apparatus, wherein the air-conditioning apparatus includes a first refrigeration cycle, in which a first compressor, a heat-source-side heat exchanger, a first expansion device, a first intermediate heat exchanger, and a first passage of a heat exchanger for heating are connected through a first refrigerant pipe, and a second refrigeration cycle, in which a second compressor, a second passage of the heat exchanger for heating, a second expansion device, and a second intermediate heat exchanger are connected through a second refrigerant pipe, wherein a first refrigerant which is charged to the first refrigeration cycle and a second refrigerant which is charged to the second refrigeration cycle are each a zeotropic refrigerant mixture having different saturated gas temperatures and saturated liquid temperatures under a same pressure, wherein heat of the first refrigerant and heat of the second refrigerant are exchanged by the heat exchanger for heating, and wherein the heat exchanger for heating is connected to the first refrigerant pipe and the second refrigerant pipe so that the first refrigerant which is supplied to the first passage of the heat exchanger for heating and the second refrigerant which is supplied to the second passage form counterflow, the refrigerant charging method comprising:

where a first temperature difference is a difference between a saturated gas temperature of the first refrigerant at an inlet side and a saturated liquid temperature of the first refrigerant at an outlet side in the heat exchanger for heating, and where a second temperature difference is a difference between a saturated gas temperature of the second refrigerant at an outlet side and a temperature of the second refrigerant at an inlet side in the heat exchanger for heating, holding a difference between the first temperature difference and the second temperature difference to a predetermined value of 1 degree C or less by charging the second refrigerant to the second refrigeration cycle so that a plurality of single refrigerants forming the second refrigerant have a predetermined mixing ratio.

2. The refrigerant charging method for the air-conditioning apparatus of claim 1, in which the first and second refrigerants are each formed of two single refrigerants, and the refrigerant charging method for air-conditioning apparatus further comprising:

charging one of the single refrigerants to the second refrigeration cycle, then charging another of the single refrigerants to the second refrigeration cycle, and keeping a predetermined ratio of the one and the another of the single refrigerants of the second refrigerant.

3. The refrigerant charging method for the air-conditioning apparatus of claim 2, in which the one single refrigerant is charged to the second refrigeration cycle by an amount smaller than a prescribed refrigerant amount of the second refrigerant which is charged to the second refrigeration cycle, and the first refrigeration cycle and the second refrigeration cycle are shipped from a factory, and in which the first refrigeration cycle and the second refrigeration cycle are installed at a site, the refrigerant charging method for the air-conditioning apparatus further comprising additionally charging the other single refrigerant to the second refrigeration cycle so that the refrigerant amount of the second refrigerant in the second refrigeration cycle is the prescribed refrigerant amount.

4. The refrigerant charging method for the air-conditioning apparatus of claim 3, wherein the one single refrigerant of each of the first refrigerant and the second refrigerant is HFO1234yf and the other single refrigerant of each of the first refrigerant and the second refrigerant is R32, or the one single refrigerant is trans-type HFO1234ze and the other single refrigerant is R32.

5. An air-conditioning apparatus charged with at least one of the first or second refrigerants by the refrigerant charging method of claim 4.

6. An air-conditioning apparatus charged with at least one of the first or second refrigerants by the refrigerant charging method of claim 3.

7. The refrigerant charging method for the air-conditioning apparatus of claim 2, wherein the one single refrigerant of each of the first refrigerant and the second refrigerant is HFO1234yf, and the other single refrigerant of each of the first refrigerant and the second refrigerant is R32, or the one single refrigerant is trans-type HFO1234ze and the other single refrigerant is R32.

8. An air-conditioning apparatus charged with at least one of the first or second refrigerants by the refrigerant charging method of claim 7.

9. An air-conditioning apparatus charged with at least one of the first or second refrigerants by the refrigerant charging method of claim 2.

10. An air-conditioning apparatus charged with at least one of the first or second refrigerants by the refrigerant charging method of claim 1.

11. A refrigerant charging method for an air-conditioning apparatus, wherein the air-conditioning apparatus includes:

a first refrigeration cycle, in which a first compressor, a heat-source-side heat exchanger, a first expansion device, a first intermediate heat exchanger, and a first passage of a heat exchanger for heating are connected through a first refrigerant pipe, a second refrigeration cycle, in which a second compressor, a second passage of the heat exchanger for heating, a second expansion device, and a second intermediate heat exchanger are connected through a second refrigerant pipe, the heat exchanger for heating is connected to the first refrigerant pipe and the second refrigerant pipe, and a first refrigerant charged to the first refrigeration cycle and a second refrigerant charged to the second refrigeration cycle are each a zeotropic refrigerant mixture having different saturated gas temperatures and saturated liquid temperatures under a same pressure, wherein the refrigerant charging method is performed during heat exchange between the first refrigerant and the second refrigerant within the heat exchanger for heating, the refrigerant charging method including:

supplying the first refrigerant in a first direction to the first passage of the heat exchanger for heating, and supplying the second refrigerant to the second passage in an opposite and counter-flowing direction to the first direction of the first refrigerant, wherein the second refrigerant is supplied in an amount effective for maintaining a difference between a first temperature difference concerning the first refrigerant and a second temperature difference concerning the second refrigerant at a predetermined value or less, the first temperature difference is a difference between a saturated gas temperature of the first refrigerant at an inlet side and a saturated liquid temperature of the first refrigerant at an outlet side in the heat exchanger for heating, and the second temperature difference is a difference between a saturated gas temperature of the second refrigerant at an outlet side and a temperature of the second refrigerant at an inlet side in the heat exchanger for heating.

12. The refrigerant charging method for the air-conditioning apparatus of claim 11, wherein the first and second refrigerants each comprise two single refrigerants mixed at a predetermined ratio, and the refrigerant charging method for air-conditioning apparatus includes:

charging one of the two single refrigerants to the second refrigeration cycle, charging another of the two single refrigerants to the second refrigeration cycle, and keeping the single refrigerants constituting the second refrigerant at the predetermined mixing ratio.

* * * * *